US005677097A

United States Patent [19]

Nukada et al.

[11] Patent Number: 5,677,097

[45] Date of Patent: Oct. 14, 1997

[54] ELECTROPHOTOGRAPHIC PHOTORECEPTOR

[75] Inventors: Hidemi Nukada; Katsumi Nukada, both of Minami-ashigara, Japan

[73] Assignee: Fuji Xerox Co., Ltd., Tokyo, Japan

[21] Appl. No.: 779,645

[22] Filed: Jan. 15, 1997

[30] Foreign Application Priority Data

Jan. 18, 1996 [JP] Japan ..... 8-006903
Aug. 26, 1996 [JP] Japan ..... 8-224239

[51] Int. Cl.[6] ..... G03G 5/047; G03G 5/14

[52] U.S. Cl. ..... 430/59; 430/58; 430/60; 430/61

[58] Field of Search ..... 430/58, 59, 60, 430/61

[56] References Cited

U.S. PATENT DOCUMENTS

| | | | |
|---|---|---|---|
| 4,535,042 | 8/1985 | Kitayama et al. | 430/61 |
| 4,801,517 | 1/1989 | Frechet et al. | 430/59 |
| 4,806,443 | 2/1989 | Yanus et al. | 430/56 |
| 4,937,165 | 6/1990 | Ong et al. | 430/59 |
| 4,959,288 | 9/1990 | Ong et al. | 430/59 |
| 5,034,296 | 7/1991 | Ong et al. | 430/59 |
| 5,356,743 | 10/1994 | Yanus et al. | 430/59 |
| 5,464,717 | 11/1995 | Sakaguchi et al. | 430/58 |
| 5,486,439 | 1/1996 | Sakakibara et al. | 430/59 |

FOREIGN PATENT DOCUMENTS

| | | |
|---|---|---|
| A-47-30330 | 11/1972 | Japan . |
| A-58-209751 | 12/1983 | Japan . |
| A-59-160147 | 9/1984 | Japan . |
| A-60-218655 | 11/1985 | Japan . |
| B2-61-35551 | 8/1986 | Japan . |
| A-62-284362 | 12/1987 | Japan . |
| A-63-210848 | 9/1988 | Japan . |
| A-4-189873 | 7/1992 | Japan . |
| A-5-43813 | 2/1993 | Japan . |
| A-5-98181 | 4/1993 | Japan . |
| A-5-140472 | 6/1993 | Japan . |
| A-5-140473 | 6/1993 | Japan . |
| A-5-263007 | 10/1993 | Japan . |
| A-5-279591 | 10/1993 | Japan . |
| A-6-151776 | 5/1994 | Japan . |
| A-6-219599 | 8/1994 | Japan . |
| A-6-250423 | 9/1994 | Japan . |
| A-6-282092 | 10/1994 | Japan . |
| A-6-329853 | 11/1994 | Japan . |
| A-6-329854 | 11/1994 | Japan . |
| A-7-24484 | 1/1995 | Japan . |
| A-7-144240 | 6/1995 | Japan . |
| A-7-161608 | 6/1995 | Japan . |

OTHER PUBLICATIONS

"The Sixth International Congress on Advances in Non-impact Printing Technologies", Oct. 21–26, 1990 pp. 306–311.

*Primary Examiner*—Roland Martin
*Attorney, Agent, or Firm*—Oliff & Berridge

[57] ABSTRACT

In an electrophotographic photoreceptor in which an undercoating layer and a photosensitive layer are provided on a conductive substrate, the undercoating layer preferably contains at least one electron transporting pigment and a reactive organometallic compound, the electron transporting pigment being selected from a group consisting of an electron transporting polycyclic quinone pigment such as brominated anthoanthrone, an electron transporting perylene pigment, an electron transporting phthalocyanine pigment, and an electron transporting azo pigment, and the surface of the electrophotographic photoreceptor contains at least one resin selected from electric charge transporting polycarbonate and electric charge transporting polyester. As a result, it is possible to provide an electrophotographic organic photoreceptor having stabilized performance and durability, which is not affected by environmental changes even when used for a long period of time and in which deterioration of the performance and electric characteristics thereof is prevented.

20 Claims, 5 Drawing Sheets

ELECTROPHOTOGRAPHIC PHOTORECEPTOR

BACKGROUND OF THE INVENTION

1. Field of the Invention

The present invention relates to an electrophotographic photoreceptor having an excellent durability and a long life.

2. Description of the Related Art

Recently, as organic photoreceptors become highly efficient, electrophotographic photoreceptors have been used even in high speed copying machines or high speed printers. However, under the existing circumstances, photoreceptors having satisfactory performance have not necessarily been obtained, and ones having a longer life are demanded strongly from the standpoint of environmental issues.

There exists a problem in that the performance of the organic photoreceptors may deteriorate due to the bodies being subjected to electrical stress for a long duration and to the influence of environmental changes. In order to overcome this problem, generally, an undercoating layer or an intermediate layer is interposed between a photosensitive layer and a substrate. As materials for forming the undercoating or intermediate layer, for example, Japanese Patent Application Laid-Open (JP-A) No. 62-284362 proposes polyurethane, polyamide, polyvinyl alcohol, epoxyethylene-acrylic acid copolymer, ethylene-vinyl acetate copolymer, casein, methylcellulose, nitrocellulose, phenol resins, organometallic compounds, and the like. However, since charges are mainly transported by water contained in these materials, a problem arises in that photosensitive properties considerably vary due to humidity.

In order to prevent changes in the photosensitive properties which is caused by the humidity, there have been proposed various methods: (1) introduction of electron-donating materials into an undercoating layer (for example, see Japanese Patent Publication (JP-B) No. 61-35551 and Japanese Patent Application Laid-Open (JP-A) No. 60-218655); (2) introduction of electric charge accepting materials into an undercoating layer (for example, Japanese Patent Publication (JP-B) No. 61-35551 and Japanese Patent Application Laid-Open (JP-A) No. 59-160147); (3) introduction of n-type dyes or pigments, or electron transporting pigments into an undercoating layer (for example, Japanese Patent Application Laid-Open (JP-A) Nos. 58-209751 and 63-210848); and so on.

However, in any of the above methods, there exist drawbacks in that sensitivity decreases, added components are eluted from the undercoating layer to a photosensitive layer or a coating liquid, a defect in a coating film of the undercoating layer occurs due to a coating solvent, and the like, and therefore, these undercoating layers do not sufficiently fulfill their function.

Further, multilayered organic photoreceptors in which an electric charge transporting layer is formed on an electric charge generating layer have nowadays been used mainly, and generally, the electric charge transporting layer particularly, electric charge transporting layer in which low molecular weight electric charge transporting material is dispersed into a binder resin forms the surface layer of the photoreceptors. The electric charge transporting layer with low molecular weight compounds having satisfactory performance with respect to electric characteristics have come to be obtained. However, since the low molecular weight electric charge transporting materials are dispersed in the binder resin, an original mechanical performance of the binder resin deteriorates and the electric charge transporting layer is essentially easily affected by wear. Accordingly, there have been proposed a method in which hard fine grains for improving wear resistance of the electric charge transporting layer, or an additive such as silicone oil, which allows decrease of surface energy, is used, and a method in which a protective layer is formed on the electric charge transporting layer (as disclosed in Japanese Patent Application Laid-Open (JP-A) No. 6-282092, and so on). However, in the above method in which additives are used in the electric charge transporting layer, low molecular weight additives are merely dispersed in the binder resin, and a great improvement cannot be expected accordingly. Further, formation of the protective layer allows improvement of the wear resistance. However, in this case, since materials used for the protective layer have high insulating properties, it is difficult to control the characteristics of the photoreceptors. Particularly, a problem arises in the stability with respect to the environmental changes.

For this reason, there has been proposed a method in which electric charge transporting high polymers are used in the protective layer (as disclosed in U.S. Pat. No. 4,801,517 and the like), or a method in which the electric charge transporting layer is hardened (as disclosed in Japanese Patent Application Laid-Open (JP-A) No. 6-250423 and the like). In these methods, so long as electric charge transporting high polymers having satisfactory performance can be obtained, there is no need of low molecular weight materials being dispersed into the electric charge transporting layer. Accordingly, the mechanical performance can be greatly improved and there is an advantage in that a conventional equipment for manufacturing organic photoreceptors can be used. However, the performance of publicly-known electric charge transporting high polymers has not been sufficient to practical use.

As described above, there have not conventionally been obtained combinations of two or more of undercoating-layer materials, electric charge generating materials, electric charge transporting materials, binder resins, additives, and the like, which satisfy all of electrophotographic characteristics such as sensitivity, receptive electric potential, electric potential retentivity, electric potential stability, residual electric potential and spectral characteristics, mechanical durability such as wear resistance, chemical stability to heat, light, discharge products, or the like, and resistance to dielectric breakdown due to discharging of electricity from an electrifier.

SUMMARY OF THE INVENTION

The present invention has been devised to overcome the above-described problems and an object of the present invention is to provide an electrophotographic organic photosensitive body in which deterioration of the performance of the body caused by electrical stress for a long duration and by the influence of environmental changes is prevented.

The present inventors have studied a method for making the lifetime of an electrophotographic photoreceptor longer without its electric properties being deteriorated and with its wear resistance being improved in a simplified manner, and as a result, they have found that by using an undercoating layer containing specific electron transporting pigments, and a surface layer containing a polycarbonate resin or a polyester resin having electric charge transporting properties, an electrophotographic photoreceptor is provided which exhibits a low residual electric potential, has a stability even in light of changes in the environment, allows keeping of excellent properties that a low residual electric potential is maintained even in the undercoating layer having a large film thickness, and has excellent durability to dielectric breakdown, wear resistance, a long life and high reliability, and the like. Thus, the present invention has been completed.

Namely, the electrophotographic photoreceptor of the present invention is an electrophotographic photoreceptor with an undercoating layer and a photosensitive layer being provided on a conductive substrate, in which the undercoating layer contains at least an electron transporting pigment and a reactive organometallic compound, and a surface layer of the electrophotographic photoreceptor contains a resin selected from electric charge transporting polycarbonate and electric charge transporting polyester.

The electrophotographic photoreceptor of the present invention has excellent durability and stability with respect to environment.

It is preferable that the electron transporting pigment includes at least one pigment selected from a group consisting of an electron transporting polycyclic quinone pigment such as brominated anthoanthrone, an electron transporting perylene pigment, an electron transporting phthalocyanine pigment, and an electron transporting azo pigment.

Further, it is preferable that the electric charge transporting polycarbonate resin or the electric charge transporting polyester resin has an aryl-amine structure, and has at least one structure represented by the following general formula (I-1) or (I-2) as a partial structure of a repeating unit:

(I-1)

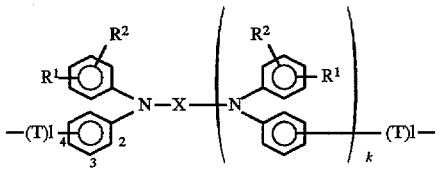

(I-2)

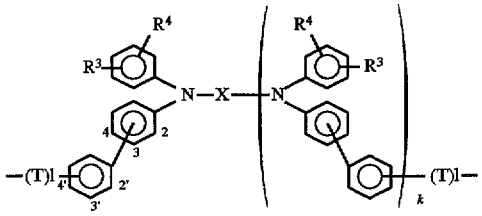

wherein $R^1$ to $R^4$ each independently represents a hydrogen atom, an alkyl group, an alkoxy group, a substituted amino group, a halogen atom, or a substituted or an unsubstituted aryl group; X represents a substituted or an unsubstituted arylene group; k and l each independently represents an integer selected from 0 and 1; and T represents an optionally branched, divalent hydrocarbon group having 1 to 10 carbon atoms.

The electric charge transporting polycarbonate resin or the electric charge transporting polyester resin is preferably represented by any one of the following general formulae (II), (III) and (IV):

$$\text{+CO—A—CO—O—(Y—O)}_{m}\text{+}_{p} \quad \text{(II)}$$

$$\text{+CO—A—CO—O—(Y—O)}_{m2}\text{—CO—Z—CO—O—(Y—O)}_{m2}\text{+}_{p2} \quad \text{(III)}$$

$$\text{+O—A—O—CO—(B—CO)}_{n}\text{+}_{p3} \quad \text{(IV)}$$

wherein A represents the structure represented by the general formula (I-1) or (I-2); B represents $—O—(Y^2O)_{m'}$ or $—Z^2—$; Y and $Y^2$ represent divalent hydrocarbon groups; Z and $Z^2$ represent divalent hydrocarbon groups; m and $m^2$ each represents an integer of 1 to 5; n represents an integer selected from 0 and 1; and p, $p^2$ and $p^3$ each represents an integer of 5 to 5000.

Moreover, the electrophotographic photoreceptor of the present invention is constructed in that the photosensitive layer can contain, as an electric charge generating material, at least one selected from halogenated gallium phthalocyanine crystals, tin-halide phthalocyanine crystals, hydroxygallium phthalocyanine crystals, and oxytitanyl phthalocyanine crystals.

The reactive organometallic compound can be selected from a group consisting of an organic zirconium compounds, organic titanium compounds, and organic aluminum compounds.

A ratio by weight of the electron transporting pigment to the reactive organometallic compound can be set in the range of 100:1 to 1:1.

The photosensitive layer comprises an electric charge generating/electric charge transporting layer, or comprises an electric charge generating layer and an electric charge transporting layer, and in this case, an electric charge generating/electric charge transporting layer, or an electric charge transporting layer can be formed as the surface layer.

DESCRIPTION OF THE PREFERRED EMBODIMENTS

The present invention will be hereinafter described in detail.

Figure 1:
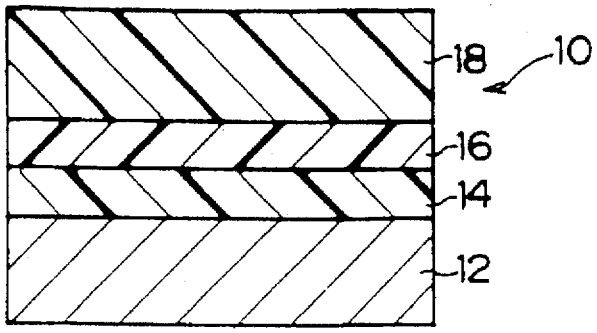
FIG. 1 is a partial cross sectional view of a multilayered electrophotographic photoreceptor according to the present invention.
Figure 2:
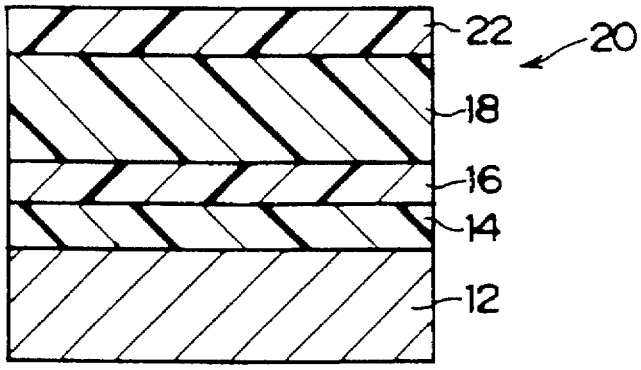
FIG. 2 is a partial cross sectional view of the multilayered electrophotographic photoreceptor having a protective layer as a surface layer thereof, according to the present invention.

FIGS. 1 through 4 are partial cross sectional views of the electrophotographic photoreceptor according to the present invention: FIGS. 1 and 2 each show the photoreceptor having a multilayered structure in which photosensitive layers are an electric charge generating layer and an electric charge transporting layer; and FIGS. 3 and 4 each show the photoreceptor having a single-layered structure in which the single photosensitive layer is an electric charge generating/ electric charge transporting layer. In a multilayered electrophotographic photoreceptor 10 shown in FIG. 1, an undercoating layer 14 is formed on a conductive substrate 12 and an electric charge generating layer 16 and an electric charge transporting layer 18 are formed on the undercoating layer 14 in order. In a multilayered electrophotographic photoreceptor 20 shown in FIG. 2, a protective layer 22 is formed, as a surface layer, on the electric charge transporting layer 18 of the multilayered electrophotographic photoreceptor 10 shown in FIG. 1.

Figure 3:
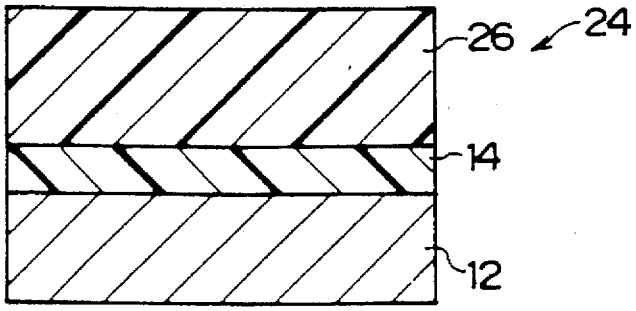
FIG. 3 is a partial cross sectional view of a single-layered electrophotographic photoreceptor according to the present invention.
Figure 4:
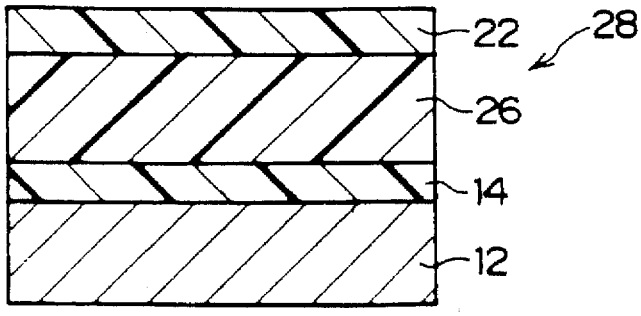
FIG. 4 is a partial cross sectional view of the single-layered electrophotographic photoreceptor .having a protective layer as a surface layer thereof, according to the present invention.

Further, in a single-layered electrophotographic photoreceptor 24 shown in FIG. 3, the undercoating layer 14 is formed on the conductive substrate 12, and an electric charge generating/electric charge transporting layer 26 is formed on the undercoating layer 14. In a single-layered electrophotographic photoreceptor 28 shown in FIG. 4, a protective layer 22 is further formed, as a surface layer, on the electric charge generating/electric charge transporting layer 26 of the single-layered electrophotographic photoreceptor 24 in FIG. 3.

The electrophotographic photoreceptor of the present invention is not particularly limited so long as specified undercoating layer and protective layer which will be described below are formed. For example, this electrophotographic photoreceptor may have any of the structures shown in the above-described drawings.

Examples of the conductive substrate of the electrophotographic photoreceptor include metals, such as aluminum, nickel, chromium and stainless steel, plastic films coated with a thin layer of materials such as aluminum, titanium, nickel, chromium, stainless steel, gold, vanadium, tin oxide, indium oxide and ITO, and a paper or plastic film coated with or impregnated with an electroconductivity imparting agent. The conductive substrate may be used in an appropriate shape such as a drum, a sheet, a plate or the like, but is not limited to such shapes. In addition, if necessary, the surface of the conductive substrate may be subjected to various treatments, in so far as these treatments do not impair the quality of image. For example, the treatments include the surface oxidizing treatment, chemical treatment, coloring treatment and/or irregular reflection treatment by means of graining.

Next, an undercoating layer will be described. The undercoating layer is provided to mainly exhibit functions of: preventing injection of unnecessary carriers from the substrate to improve the quality of image; preventing changes in an optical decay curve of the photoreceptor due to changes in the environment to obtain a stabilized quality of image; having an adequate electric charge transporting capability to prevent accumulation of electric charge even when repeatedly used over a long period of time, thereby resulting in no occurrence of changes in sensitivity; having a proper resistance to charging voltage in order to prevent occurrence of an image defect due to dielectric breakdown; causing the photosensitive layer to be adhered to a substrate; and/or blocking reflected light from the substrate if necessary.

Examples of the electron transporting pigments used for the undercoating layer of the present invention include organic pigments such as perylene pigments, bisbenzimidazole perylene pigments, polycyclic quinone pigments, indigo pigments, quinacridone pigments, bis-azo pigments having an electron-attracting substituent such as a cyano group, a nitro group, a nitroso group, a halogen atom, and phthalocyanine pigments, and inorganic pigments such as zinc oxide and titanium oxide, which are disclosed in Japanese Patent Application Laid-Open (JP-A) No. 47-30330 and the like. Among these pigments, the electron transporting polycyclic quinone pigments, electron transporting perylene pigments, electron transporting phthalocyanine pigments, electron transporting azo pigment, and the like, each having high electron transporting properties, are preferably used. The structural formulae of the concrete electron transporting pigments preferably used in the present invention are shown below, but the electron transporting pigments which can be used in the present invention are not limited to these pigments.

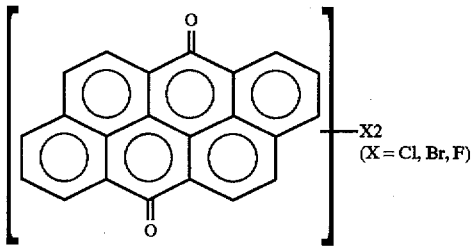

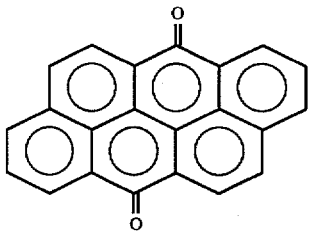

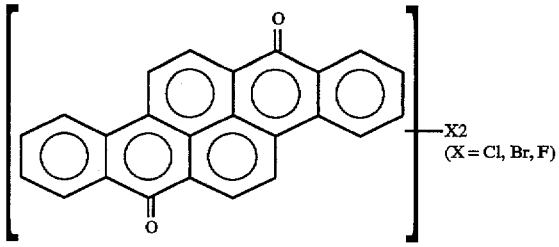

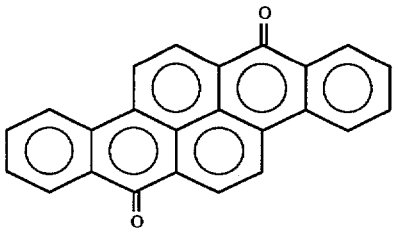

-continued
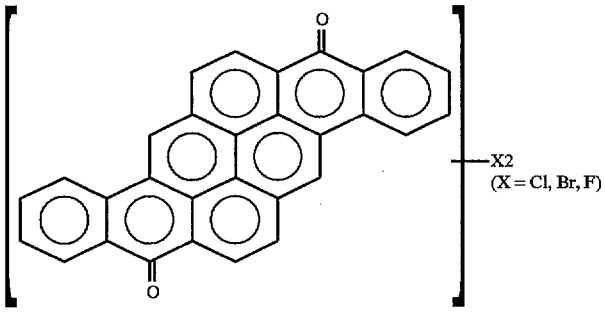
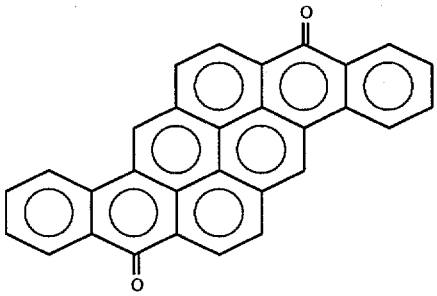
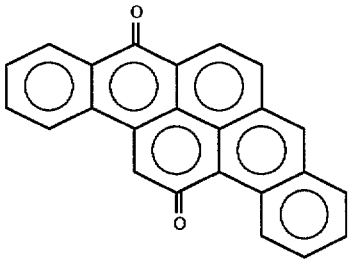
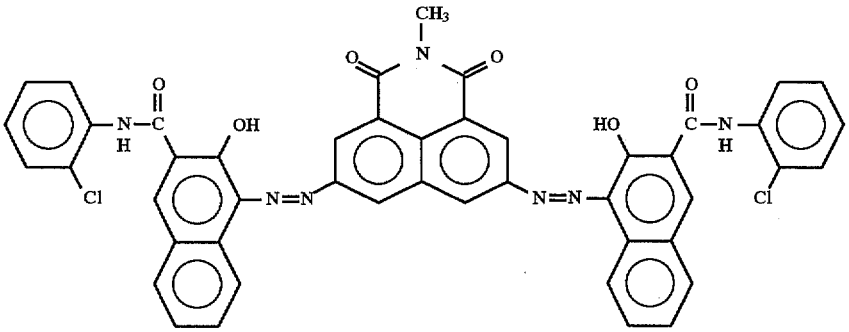
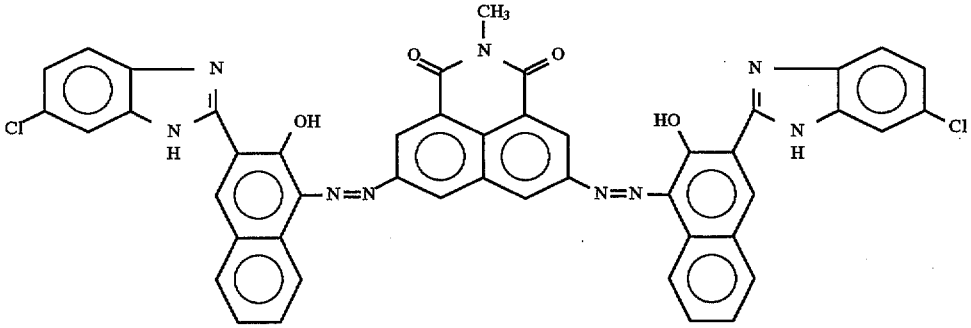
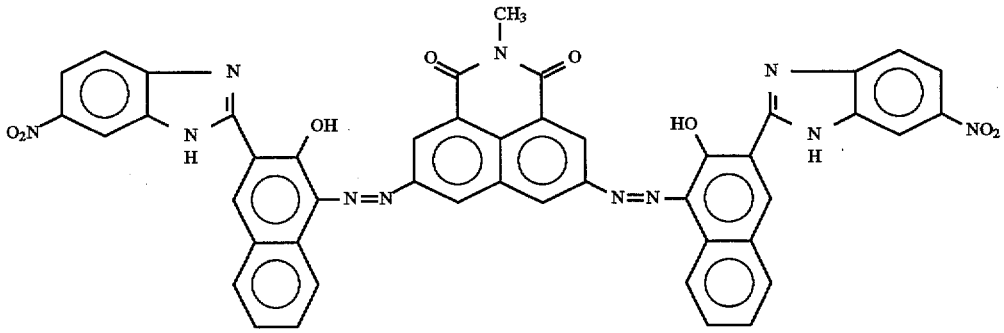

-continued
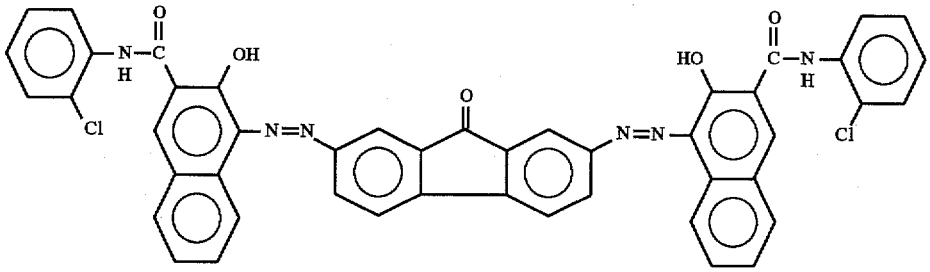
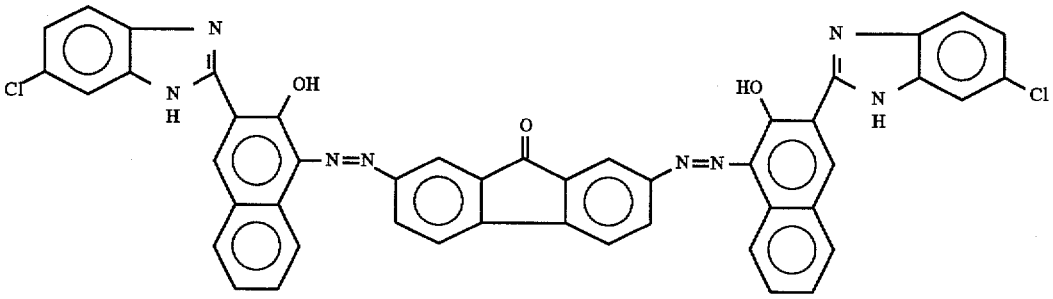
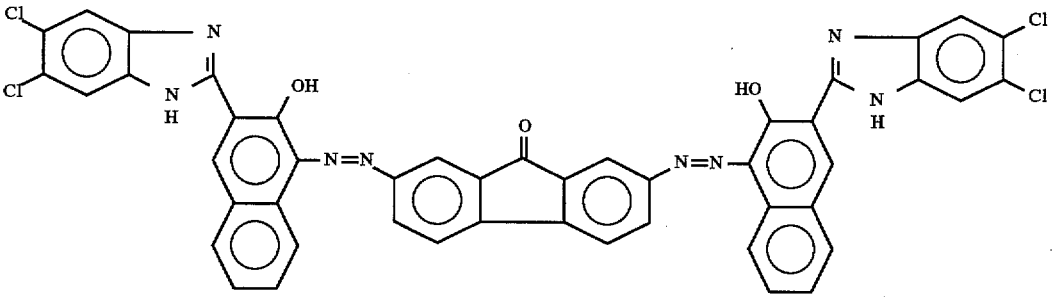
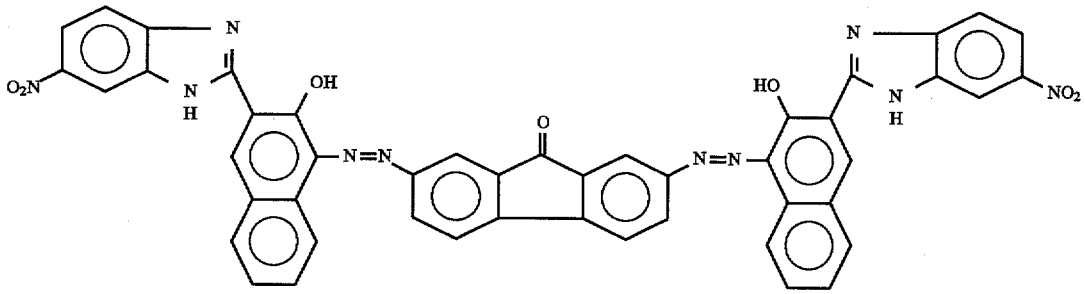
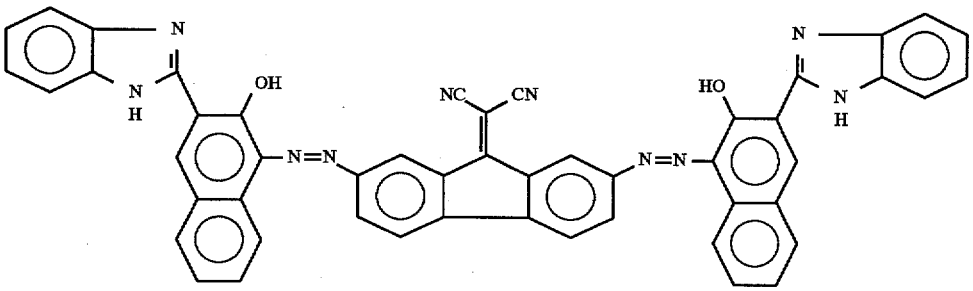

-continued
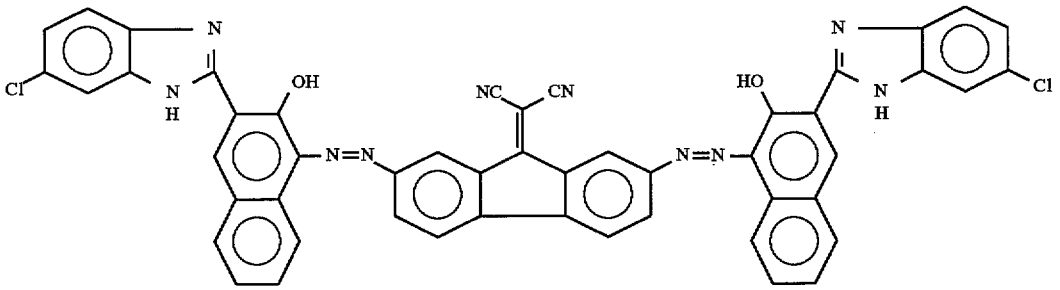
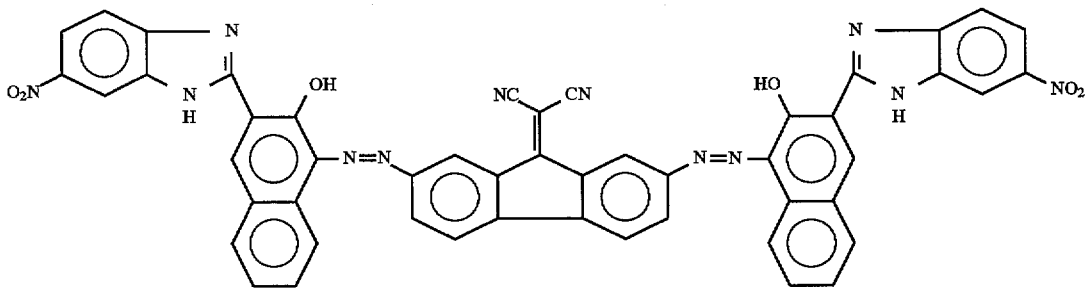
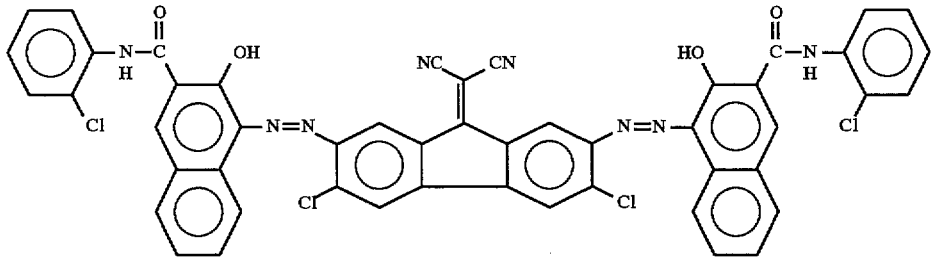
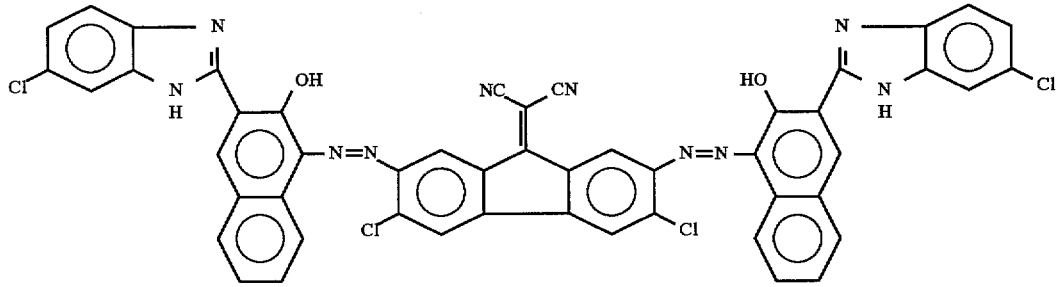
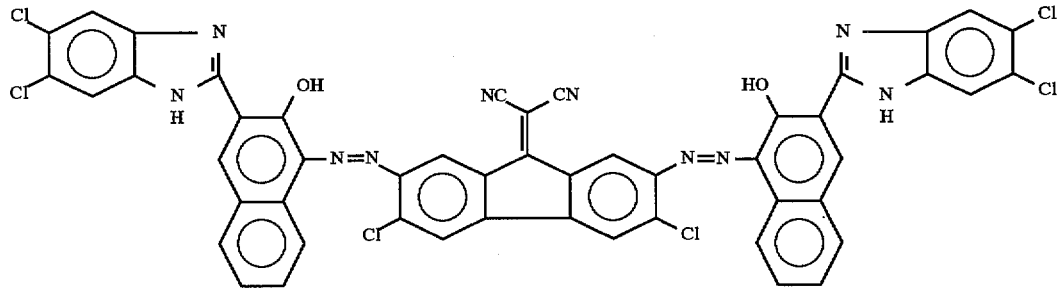

-continued
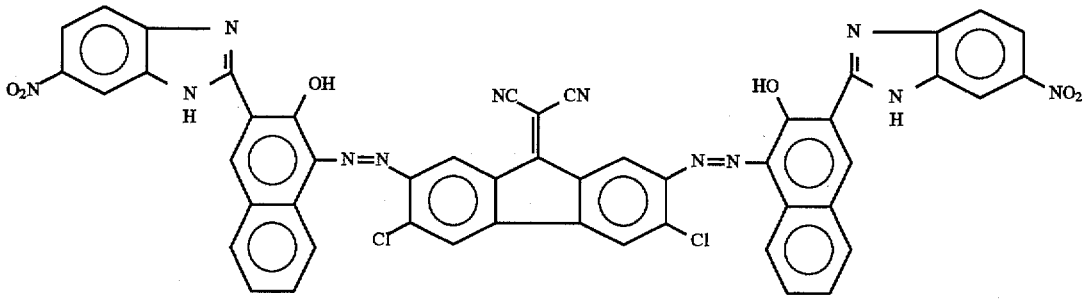
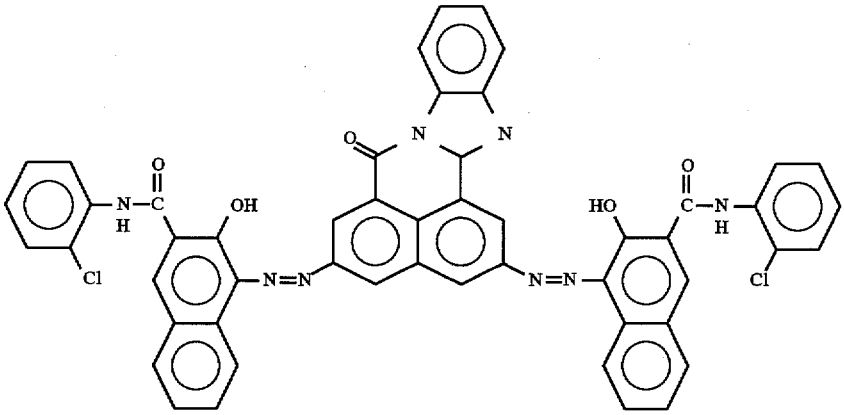
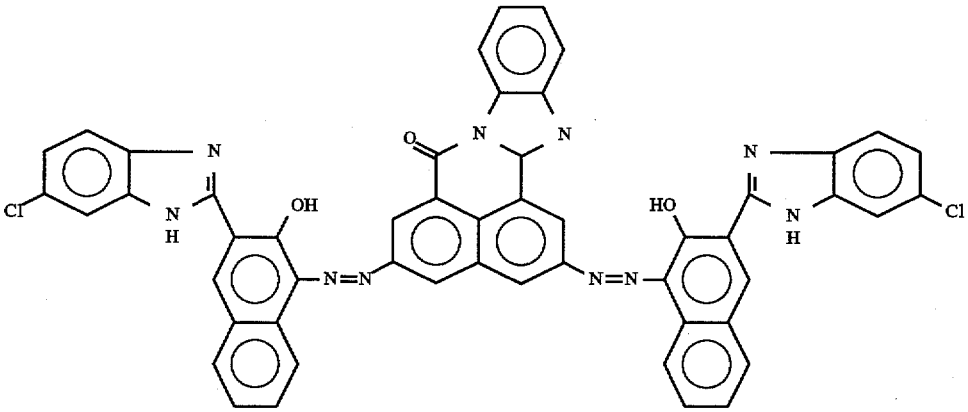
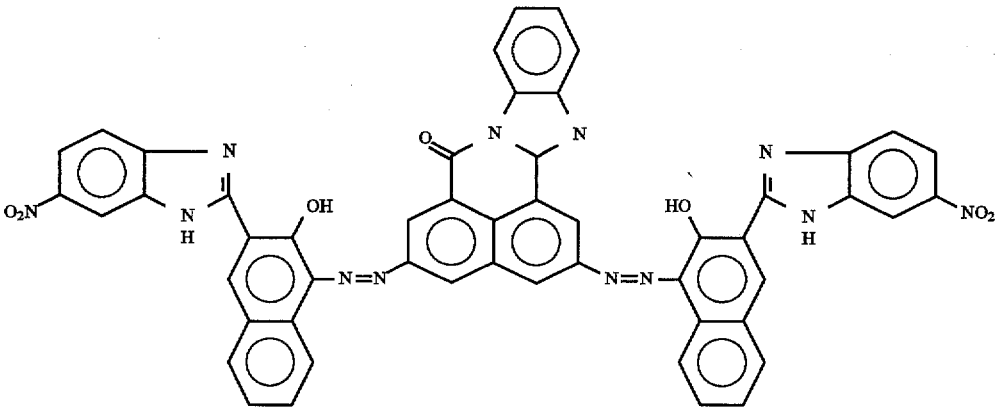

-continued
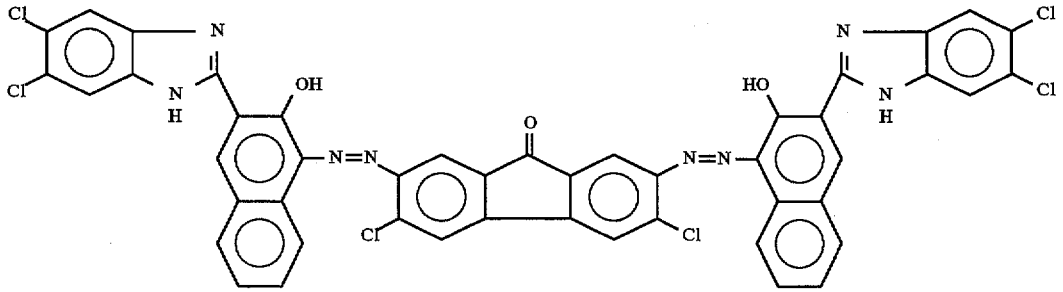
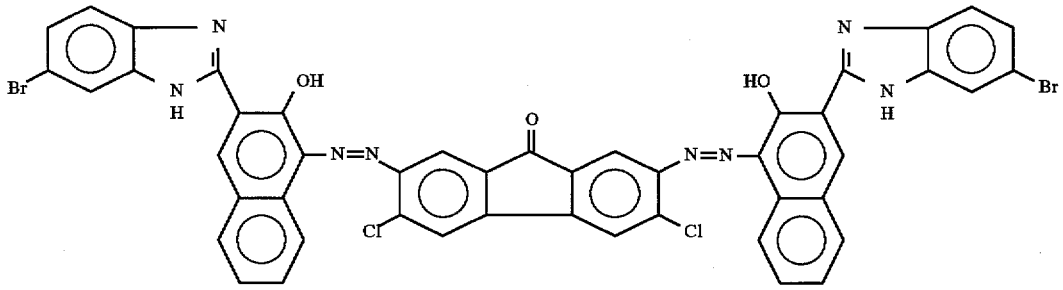
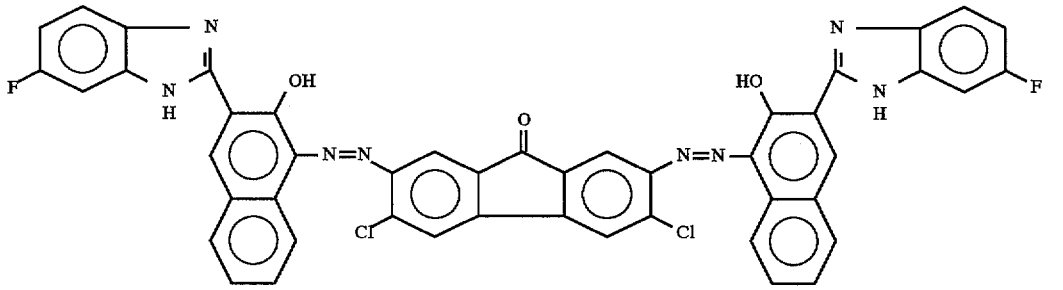
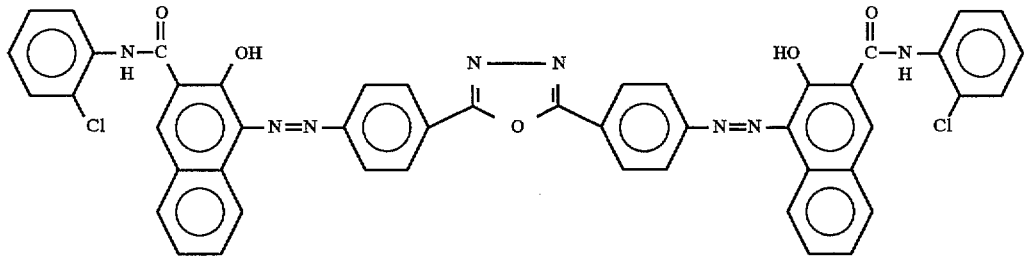
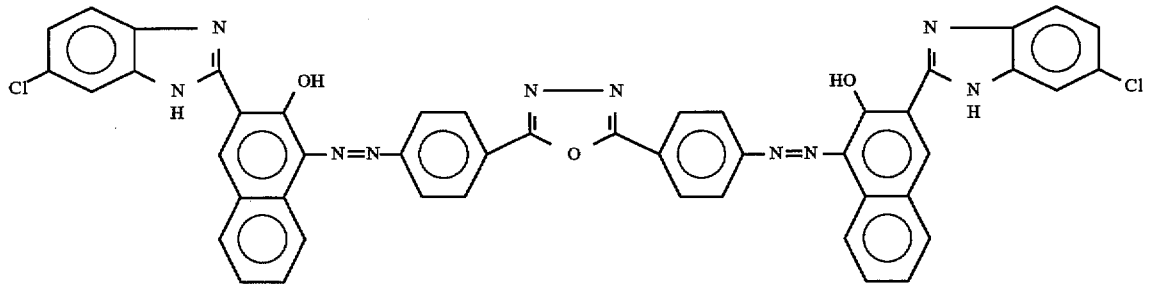

-continued
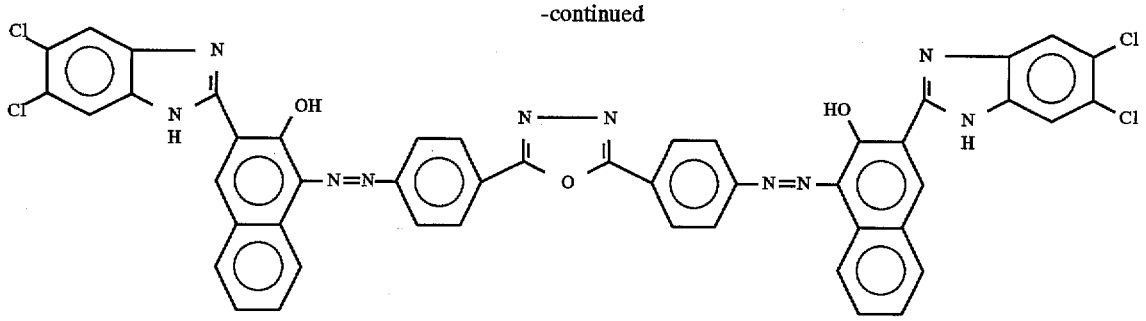
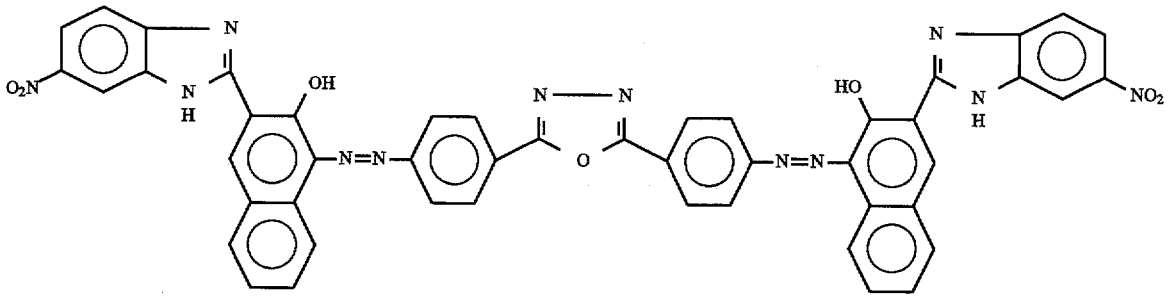
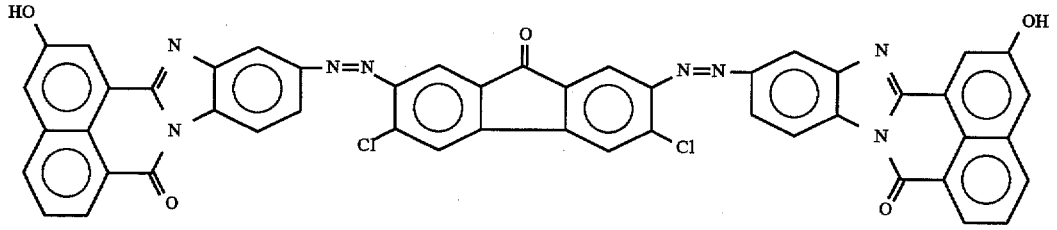
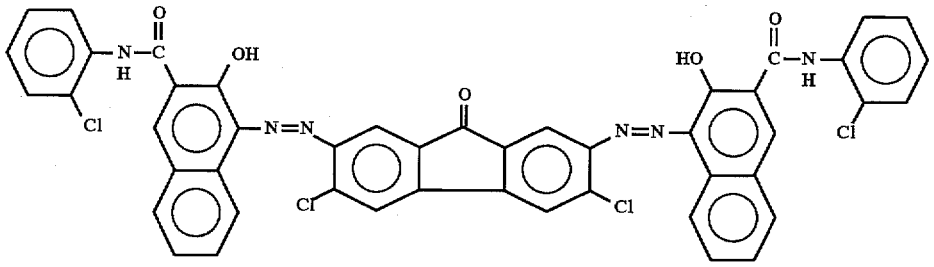
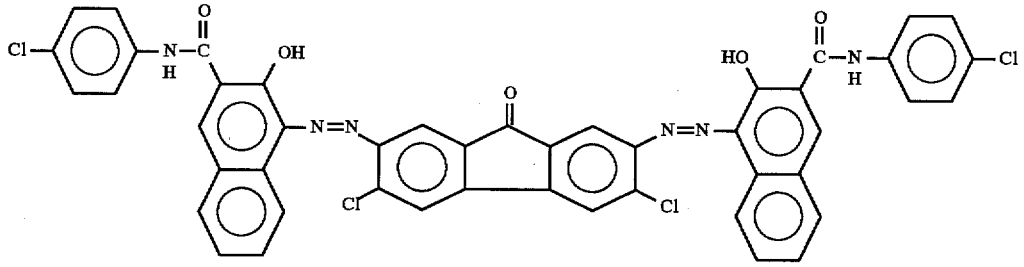
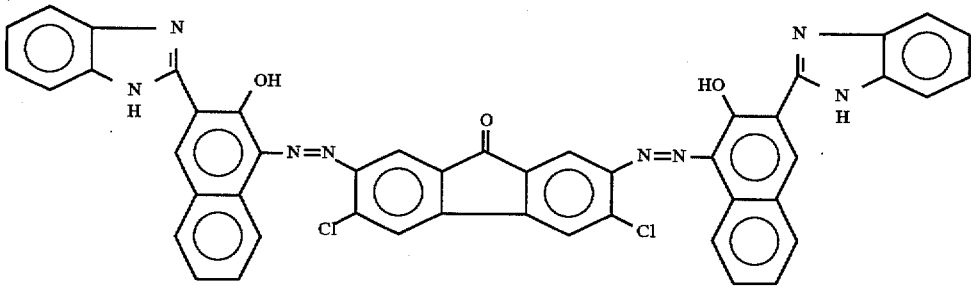

-continued
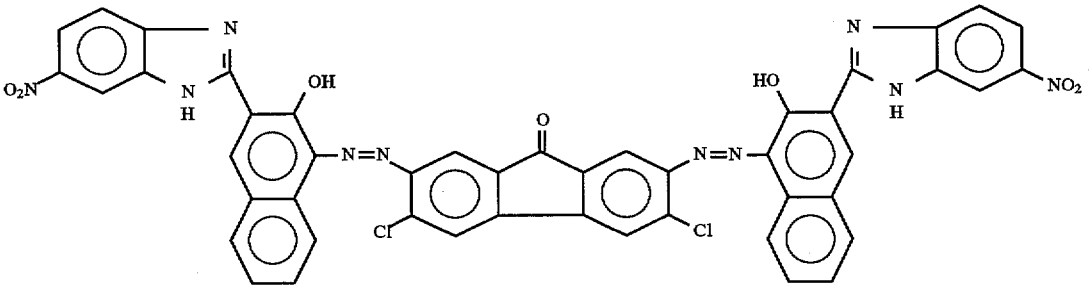
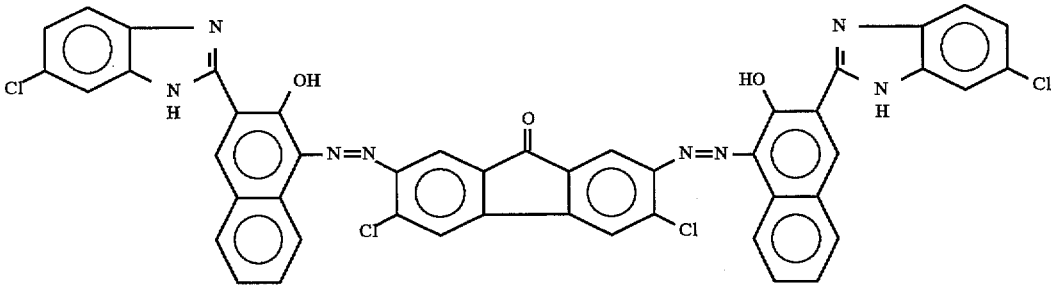
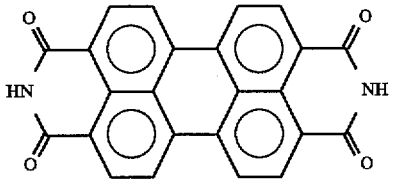
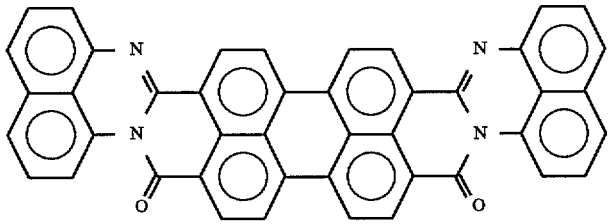
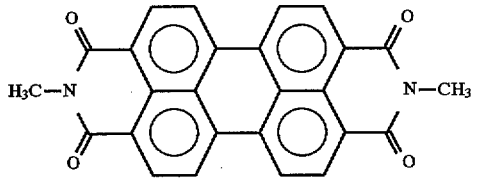
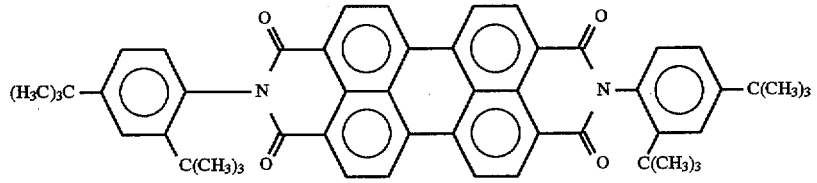
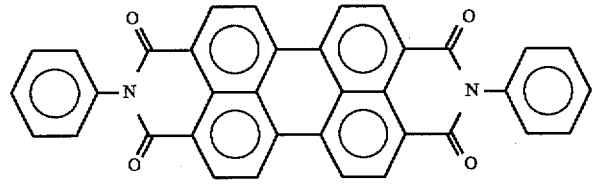

-continued
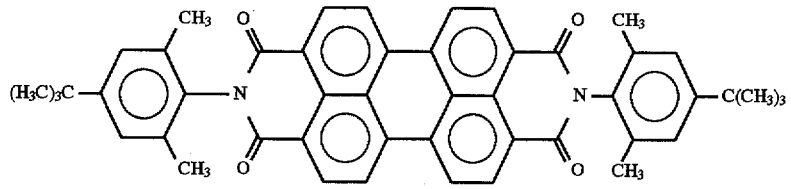
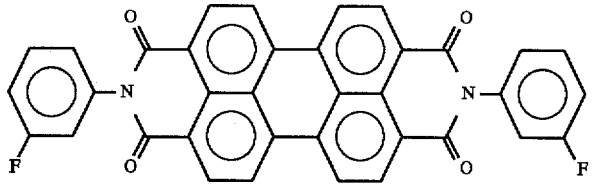
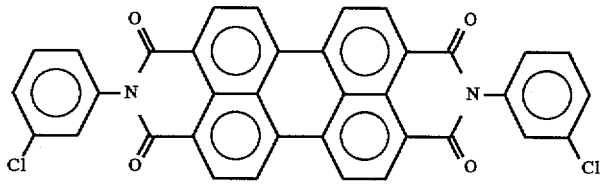
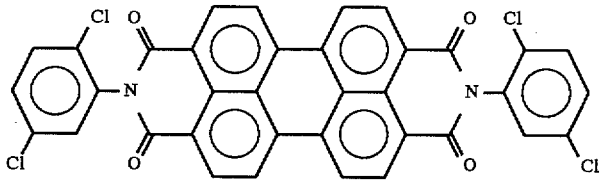
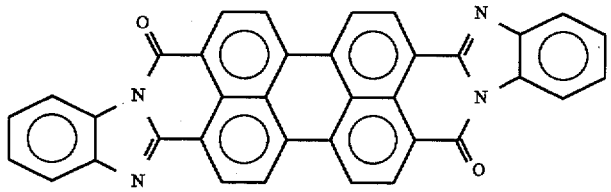
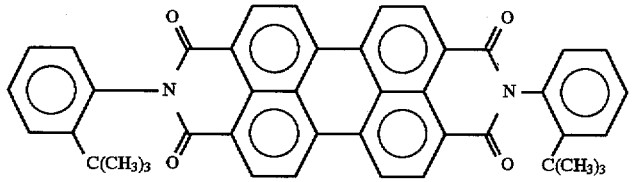
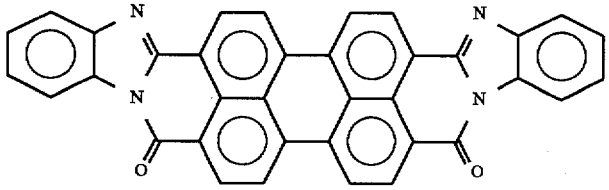
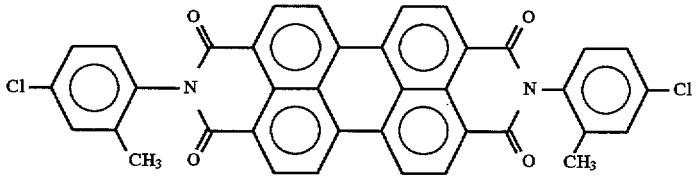

-continued
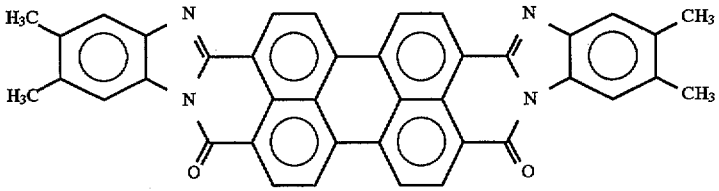
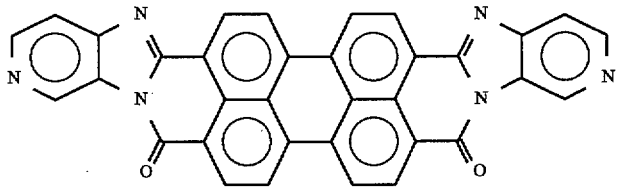
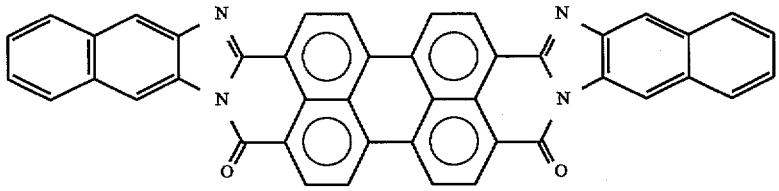
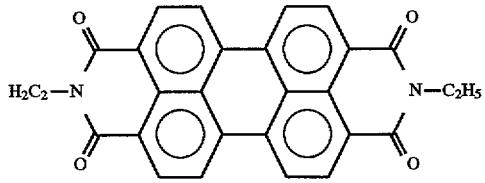
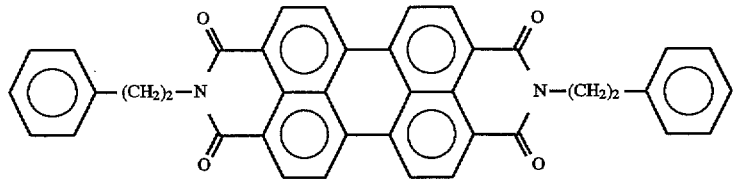
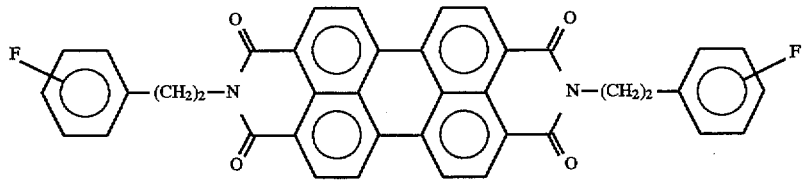
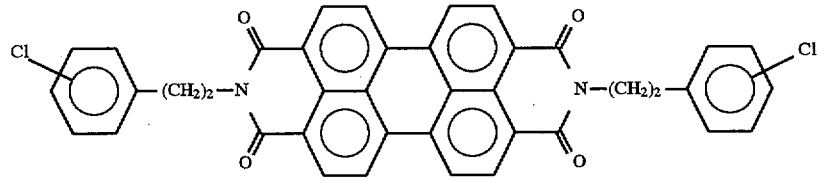
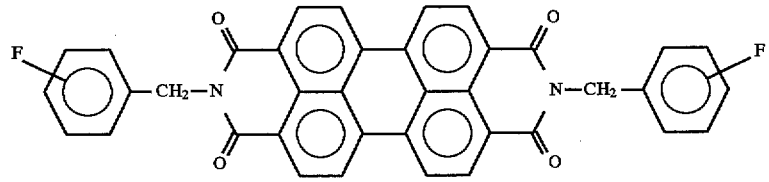

-continued
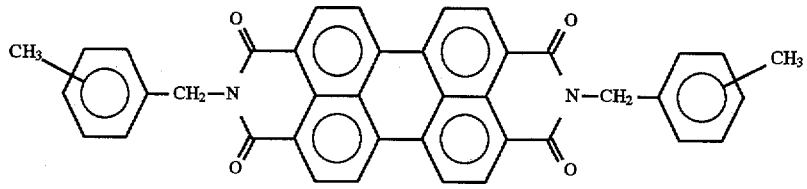
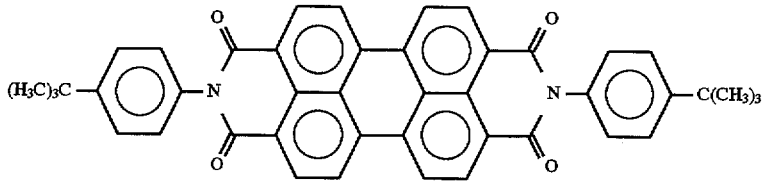
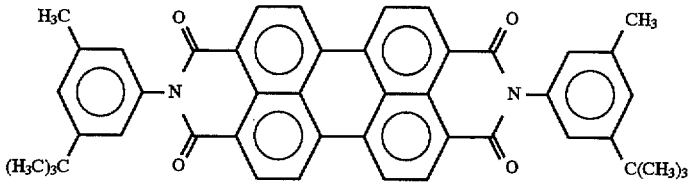
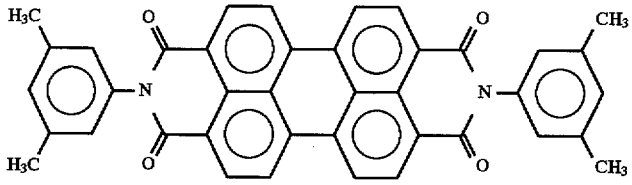
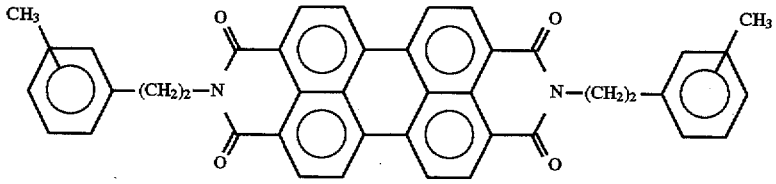
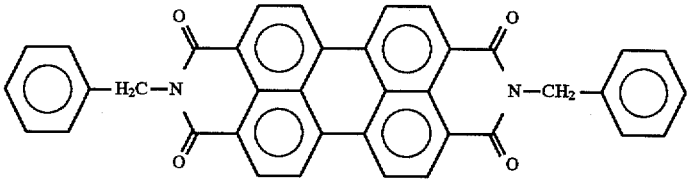
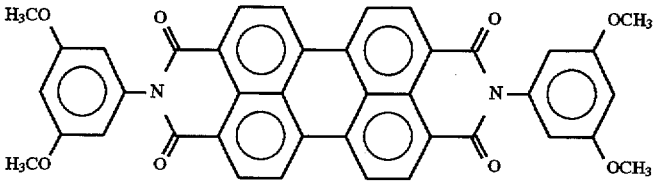

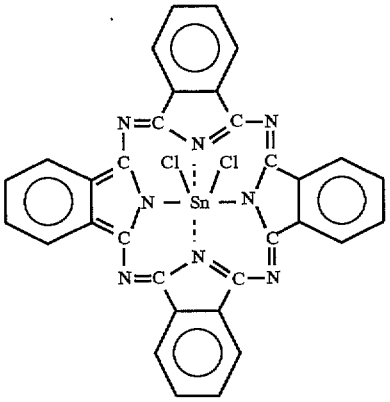

-continued

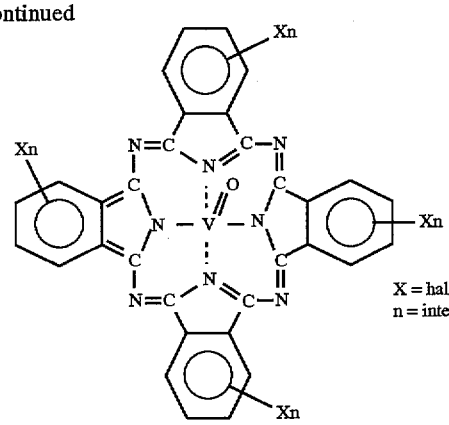

X = halogen atom
n = integer 1 to 4

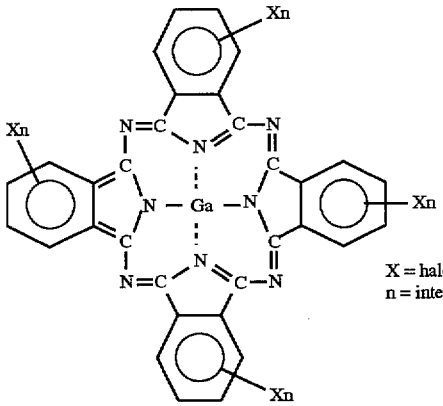

X = halogen atom
n = integer 1 to 4

The electron transporting performance of the pigments used for the undercoating layer of the present invention can be measured by using the Delayed Collection Field method. An injection-preventing layer having the shape of a thin film was placed on a Nesa glass, a coating layer having a thickness of several μm which was comprised of a resin and a pigment dispersed therein was formed on the above layer, and a gold electrode was deposited on the coating layer to obtain a condenser-shaped structure. The structure thus obtained was used as a sample. For example, with a negative voltage being applied to the side of the Nesa glass and a positive voltage being applied to the side of the gold electrode, or vice versa, laser pulse is applied from the side of the Nesa glass so that positive and negative carriers are generated on a surface of a pigment-dispersed film, the flowability of electrons and positive holes in the pigment-dispersed film was measured. At this time, a pigment having at least electron flowing properties are preferably used as the electron transporting pigment.

Added to the undercoating layer according to the present invention is a reactive organometallic compound which serves as a hardening agent which prevents dissolution of the undercoating layer, the dissolution being caused by a solvent used for coating of a layer formed on the undercoating layer, or as an additive for improving blocking performance. Examples of the reactive organometallic compound include, but are not limited to, organic zirconium compounds such as zirconium chelate compounds, zirconium alkoxide compounds and zirconium coupling agents, organic titanium compounds such as titanium chelate compounds, titanium alkoxide compounds and titanium coupling agents, organic aluminum compounds such as aluminum chelate compounds and aluminum coupling agents, antimony alkoxide compounds, germanium alkoxide compounds, indium alkoxide compounds, indium chelate compounds, manganese chelate compounds, manganese alkoxide compounds, tin chelate compounds, tin alkoxide compounds, aluminum silicon alkoxide compounds, aluminum titanium alkoxide compounds, aluminum zirconium alkoxide compounds, and the like. Among these reactive organic metallic compounds, the organic zirconium compounds, organic titanium compounds, and organic aluminum compounds, particularly, the zirconium chelate compounds, zirconium alkoxide compounds, and titanium alkoxide compounds, each having a low residual electric potential and exhibiting excellent electrophotographic properties, are preferably used.

In the undercoating layer according to the present invention, the electron transporting pigment and the reactive organometallic compound can be mixed with or dispersed in the binder resin. As the binder resin, publicly-known materials used in the undercoating layer can be used. Specific examples of the binder resin include polyvinyl alcohol resins, polyvinyl acetal resins, polyvinyl methyl ether resins, poly-N-vinyl imidazole resins, polyethylene oxide resins, ethyl cellulose resins, methyl cellulose resins, ethylene-acrylic acid copolymers, polyamide resins, polyimide resins, casein resins, gelatin resins, polyethylene resins, polyester resins, phenol resins, vinylchloride-vinylacetate copolymers, epoxy resins, polyvinyl pyrolidone resins, polyvinyl pyridine resins, polyurethane resins, polyglutamic-acid resins, and polyacrylic- acid resins. Among these resins, the binder resin having a hydroxyl group which is apt to react with, for example, cross-link with the reactive organometallic compounds contained in the undercoating layer is preferably used, but the binder resin which can be used in the present invention is not limited to these resins. These resins may be used alone or in combination of two or more of them.

When the electron transporting pigment and reactive organometallic compound are mixed in the undercoating layer according to the present invention, there can be used any of a method of dispersing the electron transporting pigment into a solution containing the organometallic compound, a method of adding and mixing the organometallic compound in a dispersion liquid in which the electron transporting pigment is dispersed, a method in which the electron transporting pigment is dispersed in the binder resin and the organometallic compound is added and mixed thereto, a method in which after the organometallic compound is added and mixed to the binder resin, the electron transporting pigment is dispersed therein, a method in which the organometallic compound is added and mixed to the electron transporting pigment, and the mixture obtained is dispersed in the binder resin, and the like. In these methods, it is important that when these materials used are mixed and dispersed, gelation or aggregation should not occur.

The ratio by weight of the electron transporting pigments to the organometallic compounds is set in the range of 100:1 to 1:1. Further, when the binder resin is used, the ratio by weight of the electron transporting pigments to the resin is set in the range of 1:10 to 9:1, preferably 5:5 to 9:1. When the weight of the electron transporting pigments is small, the electron-transfer effect decreases and changes in the characteristics caused by those in the environment increases. Further, the weight of the electron transporting pigments is too large, the life time of the coating liquid becomes shorter and a coating problem may arise in that components in the coating liquid aggregate.

As the mixing/dispersion method, an ordinary method using a ball mill, roll mill, sand mill, atritor, ultrasonic waves, or the like is used. The mixing/dispersion processing is carried out in an organic solvent. As the organic solvent, any organic solvent can be used in which the binder resin is dissolved and when the electron transporting pigment is mixed and dispersed in the solvent, the electron transporting pigment particles do not aggregate. For example, examples of the organic solvent include methanol, ethanol, n-propanol, n-butanol, benzil alcohol, methyl cellosolve™, ethyl cellosolve™, acetone, methyl ethyl ketone, cyclohexanone, methyl acetate, n-butyl acetate, dioxane, tetrahydrofuran, methylenechloride, chloroform, chlorbenzene, toluene, and the like. These organic solvents can be used alone or in a combination of two or more of them.

Further, a silane coupling agent may be contained in the undercoating layer of the present invention to improve the quality of image. Any of publicly-known silane coupling agents can be used. Examples of the silane coupling agent include vinyltrichlorosilane, vinyltrimethoxysilane, vinyltriethoxysilane, vinyltris(2-methoxyethoxy)silane, vinyltriacetoxysilane, γ-glycydoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidepropyltriethoxysilane, β-3,4-epoxycyclohexyltrimethoxysilane, and the like. In the present invention, the silane coupling agent can be used in any mixing ratio as occasion demands.

The thickness of the undercoating layer used for the photoreceptor of the present invention is generally set in the range of 0.1 to 20 μm, preferably 0.5 to 10 μm. Further, as a method of coating the undercoating layer, ordinary methods such as blade coating, wire bar coating, spray coating, dip coating, bead coating, air knife coating, curtain coating, and the like can be used. The undercoating layer is obtained by drying coated materials. Usually, drying processing is carried out at a temperature which evaporates the solvent to form a film.

Next, a description will be given of an electric charge generating layer which is provided in the case in which the electrophotographic photoreceptor has photosensitive layers. The electric charge generating layer comprises known electric charge generating materials and binder resins.

All of known electric charge generating materials can be used, and particularly, a metal phthalocyanine pigment and a metal-free phthalocyanine pigment are preferably used. Among these pigments, hydroxygallium phthalocyanine, chlorogallium phthalocyanine, dichlorostannic phthalocyanine, and titanyl phthalocyanine, each having a specified (new) crystal structure, are particularly preferable. A new crystal-form chlorogallium phthalocyanine can be produced in the following manner disclosed in Japanese Patent Application Laid-Open (JP-A) No. 5-98181. Chlorogallium phthalocyanine crystals manufactured in a publicly-known method are subjected to dry milling in a mechanical manner by an automatic mortar, a planetary mill, a vibrating mill, a CF mill, a roller mill, a sand mill, a kneader, or the like, or after dry milling, subjected to wet milling together with a solvent by a ball mill, a mortar, a sand mill, a kneader, or the like. Examples of the solvent used in the above-described processing include aromatics (such as toluene and chlorobenzene), amides (such as dimethylformamide and N-methylpyrolidone), fatty alcohols (such as methanol, ethanol, and butanol), fatty polyhydric alcohols (such as ethyleneglycol, glycerine, polyethyleneglycol), aromatic alcohols (such as benzyl alcohol and phenethyl alcohol), esters (such as ester acetate and butyl acetate), ketones (such as acetone and methyl ethyl ketone), dimethylsulfoxides, ethers (such as diethyl ether and tetrahydrofuran), mixtures thereof, mixtures of water and these organic solvents, and the like. The solvent is used in the range of 1 to 200 parts by weight, preferably 10 to 100 parts by weight to 1 part by weight of chlorogallium phthalocyanine. The processing temperature is set in the range of 0° C. to a boiling point of the solvent, preferably 10° C. to 60° C. Further, at the time of milling, a milling auxiliary agent such as sodium chloride and Glauber's salt can also be used. The milling auxiliary agent is used in the range of 0.5 to 20 times, preferably 1 to 10 times the quantity of the pigments (in the ratio of weight).

The new crystal-form dichlorostannic phthalocyanine can be manufactured, as disclosed in Japanese Patent Application Laid-Open (JP-A) Nos. 5-140472 and 5-140473, in such a manner that dichlorostannic phthalocyanine crystals manufactured in a publicly-known method is subjected to milling and solvent processing in the same way as in the above chlorogallium phthalocyanine.

The new crystal-form hydroxygallium phthalocyanine can be manufactured in the following manner disclosed in Japanese Patent Application Laid-Open (JP-A) Nos. 5-263007 and 5-279591. Chlorogallium phthalocyanine crystals manufactured by a publicly-known method are subjected to hydrolysis or acid pasting in an acid or alkaline solution in order to synthesize hydroxygallium phthalocyanine crystals. The obtained hydroxygallium phthalocyanine crystals are processed directly with the solvent, or subjected, together with the solvent, to wet milling processing by using a ball mill, a mortar, a sand mill, a kneader or the like, or after having been subjected to dry milling processing without the solvent being used together, subjected to solvent processing. Examples of the solvent used in the above-described processing include aromatics (such as toluene and chlorobenzene), amides (such as dimethylformamide and N-methylpyrolidone), fatty alcohols (such as methanol, ethanol, and butanol), fatty polyhydric alcohols (such as ethyleneglycol, glycerine, polyethyleneglycol), aromatic alcohols (such as benzyl alcohol and phenethyl alcohol), esters (such as ester acetate and butyl acetate), ketones (such as acetone and methyl ethyl ketone), dimethylsulfoxides, ethers (such as diethyl ether and tetrahydrofuran), mixtures thereof, mixtures of water and these organic solvents, and the like. The solvent is used in the range of 1 to 200 parts by weight, preferably 10 to 100 parts by weight to 1 part of hydroxygallium phthalocyanine. The processing temperature is set in the range of 0° C. to 150° C., preferably in the range of a room temperature to 100° C. Further, at the time of milling, a milling auxiliary agent such as sodium chloride and Glauber's salt can also be used. The milling auxiliary agent is used in the range of 0.5 to 20 times, preferably 1 to 10 times the quantity of the pigments (in the ratio of weight).

The new crystal-form oxytitanyl phthalocyanine can be manufactured in the following manner disclosed in Japanese Patent Application Laid-Open (JP-A) Nos. 4-189873 and 5-43813. The oxytitanyl phthalocyanine crystals manufactured by a publicly-known method are subjected to acid pasting or salt milling, together with inorganic salt, by using a ball mill, a mortar, a sand mill, a kneader, or the like, so as to form oxytitanyl phthalocyanine crystals having a relatively low crystallinity with a peak point of 27.2° in the X-ray diffraction spectrum. The resulting oxytitanyl phthalocyanine crystals are directly subjected to solvent processing, or subjected, together with a solvent, to wet milling processing by using a ball mill, a mortar, a sand mill, a kneader, or the like. A preferred example of an acid used for acid pasting is sulfuric acid, especially, the sulfuric acid having a density of 70 to 100%, preferably 95 to 100%, and a soluble temperature is set in the range of −20° to 100° C., preferably 0° to 60° C. The amount of concentrated sulfuric acid is set in the range of 1 to 100 times, preferably 3 to 50 times the weight of the oxytitanyl phthalocyanine crystals. As the solvent for separation, water or a mixture of water and the organic solvent is used in any amount, and particularly, the mixture of water and an alcohol solvent such as methanol and ethanol, or the mixture of water and an aromatic solvent such as benzene and toluene is preferably used. The separation temperature is not particularly limited, but in order to prevent generation of heat, a system of reaction is preferably cooled with ice. Further, the ratio of weight of the oxytitanyl phthalocyanine crystals to the inorganic salt is set in the range of 1:0.1 to 1:20, preferably in the range of 1:0.5 to 1:5. Examples of the solvent used in the above-described solvent processing include aromatics (such as toluene and chlorobenzene), fatty alcohols (such as methanol, ethanol, and butanol), hydrocarbons with halogen substituent (such as dichloromethane, chloroform, and trichloroethane), mixtures thereof, mixtures of water and these organic solvent, and the like. The solvent used herein is used in the range of 1 to 100 parts by weight, preferably 5 to 50 parts by weight, to 1 part by weight of oxytitanyl phthalocyanine. The processing temperature is set in the range of a room temperature to 100° C., preferably in the range of 50° to 100° C. The milling auxiliary agent is used in the range of 0.5 to 20 times, preferably 1 to 10 times the quantity of the pigments (in the ratio of weight).

The binder resin can be selected from a wide range of insulating resins, and can also be selected from organic photoconductive polymers such as poly-N-vinylcarbazole, polyvinylanthracene, polyvinylpyrene, and polysilane. Preferred examples of the binder resin include polyvinylbutyral resins, polyarylate resins (such as polycondensation product of bisphenol A and phthalic acid), polycarbonate resins, polyester resins, phenoxy resins, vinylchloride-vinylacetate copolymers, polyamide resins, acrylic resins, polyacrylamide resins, polyvinylpyridine resins, cellulose resins, urethane resins, epoxy resins, casein, polyvinylalcohol resins, polyvinylpyrolidone resins, and the like. However, the binder resin are not limited to the above-described ones. These binder resins may be used alone or in combination of two or more of them.

The blending ratio (i.e., the ratio by weight) of the electric charge generating material to the binder resin is preferably set in the range of 10:1 to 1:10. In order to disperse the electric charge generating material in the binder resin, an ordinary method such as a ball mill dispersion method, an atritor dispersion method, and a sand mill dispersion method can be used, provided that the crystal form of the electric charge generating material should not change when the material is dispersed. It was confirmed that in any of the above-described dispersion methods carried out in the present embodiment, the crystal form did not change as compared with that prior to the dispersion. Further, in this dispersion method, it is effective that a grain size is set to be less than or equal to 0.5 μm, preferably less than or equal to 0.3 μm, and more preferably less than or equal to 0.15 μm. Examples of the solvent used in the dispersion method include methanol, ethanol, n- propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylenechloride, chloroform, chlorbenzene, toluene, and the like. These solvents may be used alone or in combination of two or more of them. The thickness of the electric charge generating layer used in the present invention is generally set in the range of 0.1 to 5 μm, preferably 0.2 to 2.0 μm. The coating method of the electric charge generating layer includes blade coating, wire bar coating, spray coating, dip coating, bead coating, air knife coating, curtain coating, and the like.

Next, a surface layer of the photoreceptor of the present invention will be described. An electric charge transporting polycarbonate resin and/or electric charge transporting polyester resin is used for the surface layer in the present invention. Accordingly, since none of other low molecular weight electric charge transporting materials is used or these materials can be remarkably lessened, wear resistance improves considerably.

In the present invention, the surface layer means an outermost layer of the photoreceptor. For example, in a multilayered photoreceptor, when an electric charge transporting layer is provided as the outermost layer, the electric charge transporting layer forms the surface layer. When an electric charge generating/electric charge transporting layer is provided as the outermost layer of the single-layer photoreceptor, the electric charge generating/electric charge transporting layer forms the surface layer. Further, when the outermost layer of the multilayered or single-layer photoreceptor is a protective layer, the protective layer forms the surface layer. When the protective layer is provided as the outermost layer of the multilayered photoreceptor, the order of lamination of the electric charge generating layer and the electric charge transporting layer can be set arbitrarily. Accordingly, the electric charge generating layer may be formed on the electric charge transporting layer.

As the electric charge transporting polycarbonate resin or the electric charge transporting polyester resin, for example, any of the materials disclosed in U.S. Pat. Nos. 4,806,443, 4,806,444, 4,801,517, 4,937,165, 4,959,288, 5,034,296, and Japanese Patent Application Nos. 6-151776, 6-219599, 6-329854, 6-329853, 7-24484, 7-144240, 7-161608, which have previously filed by the assignee of the present application, can be used. Particularly, a resin having at least one structure represented by the following general formula (I-1) or (I-2) as a partial structure of the repeating unit, more specifically, the electric charge transporting polycarbonate resins or the electric charge transporting polyester resins, expressed by the following general formulae (II) to (IV), are preferably used. Examples of structures represented by the general formulae (I-1) and (I-2) are shown in Table 1 through Table 6 below, and concrete examples of the electric charge transporting polycarbonate resins or the electric charge transporting polyester resins, represented by the general formulae (II), (III) and (IV), are shown in Table 7 through Table 9. However, the electric charge transporting resins which can be used in the present invention are not limited to these examples.

TABLE 1

General formula (I-1)

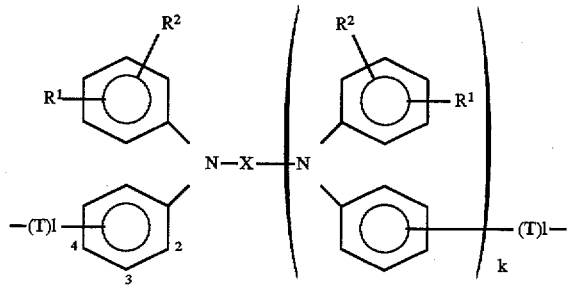

| Compound number | X | $R^1$ | $R^2$ | Position for bonding | k | T |
|---|---|---|---|---|---|---|
| 1 | 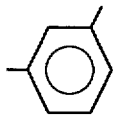 | H | H | 3 | 0 | T-2 |
| 2 | 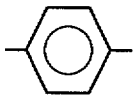 | H | H | 3 | 0 | T-2 |
| 3 | 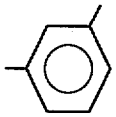 | 3-Me | 4-Me | 3 | 0 | T-2 |
| 4 | 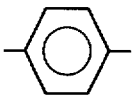 | 3-Me | 4-Me | 4 | 0 | T-2 |
| 5 | 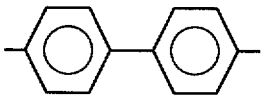 | H | H | 3 | 1 | — |
| 6 | 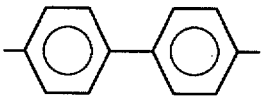 | H | H | 3 | 1 | T-2 |
| 7 | 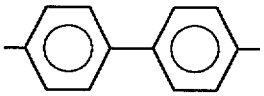 | H | H | 3 | 1 | T-51 |
| 8 | 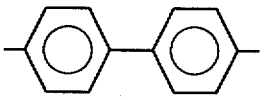 | H | 4-Me | 3 | 1 | T-2 |

TABLE 1-continued
General formula (I-1)
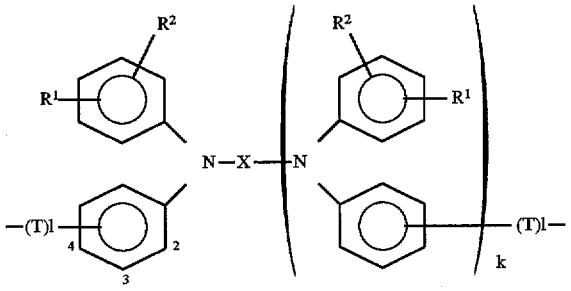
| Compound number | X | $R^1$ | $R^2$ | Position for bonding | k | T |
|---|---|---|---|---|---|---|
| 9 | 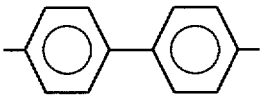 | H | 4-Ph | 3 | 1 | T-2 |
| 10 | 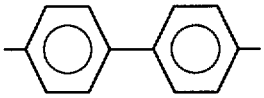 | 3-Me | 4-Me | 3 | 1 | T-8l |
| 11 | 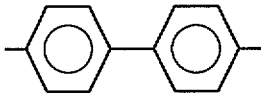 | 3-Me | 4-Me | 3 | 1 | T-25l |
| 12 | 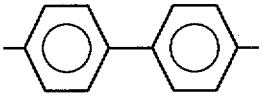 | H | H | 4 | 1 | T-5r |
| 13 | 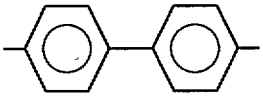 | H | H | 4 | 1 | T-1 |
| 14 | 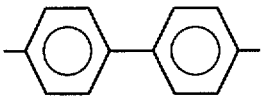 | H | H | 4 | 1 | T-2 |
TABLE 2
| Compound number | X | $R^1$ | $R^2$ | Position for bonding | k | T |
|---|---|---|---|---|---|---|
| 15 | 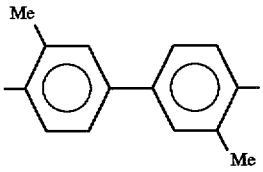 | 3-Me | 4-Me | 3 | 1 | — |

TABLE 2-continued
| Compound number | X | $R^1$ | $R^2$ | Position for bonding | k | T |
|---|---|---|---|---|---|---|
| 16 | 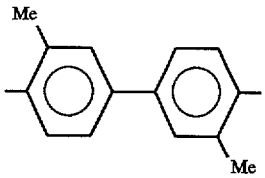 | H | H | 3 | 1 | T-2 |
| 17 | 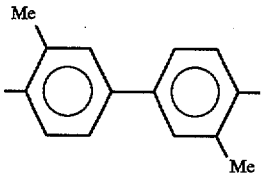 | H | 4-Me | 3 | 1 | T-2 |
| 18 | 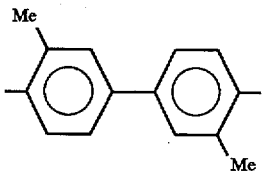 | 3-Me | 4-Me | 4 | 1 | T-1 |
| 19 | 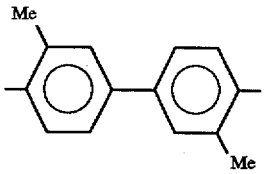 | 3-Me | 4-Me | 4 | 1 | T-2 |
| 20 | 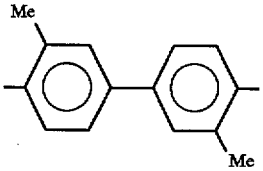 | 3-Me | 4-Me | 4 | 1 | T-4 |
| 21 | 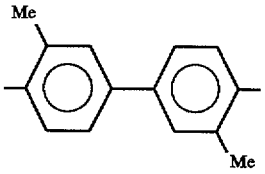 | H | 4-OMe | 4 | 1 | T-2 |
| 22 | 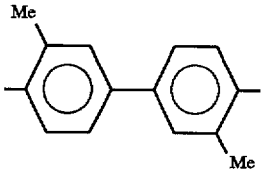 | 3-Me | 4-Me | 4 | 1 | T-51 |
| 23 | 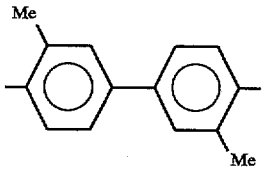 | 4-Me | H | 4 | 1 | T-131 |

TABLE 2-continued
| Compound number | X | $R^1$ | $R^2$ | Position for bonding | k | T |
|---|---|---|---|---|---|---|
| 24 | 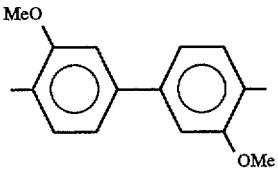 | H | H | 3 | 1 | — |
| 25 | 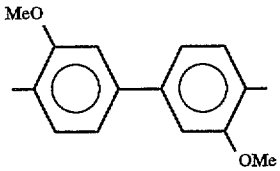 | H | H | 3 | 1 | T-2 |
| 26 | 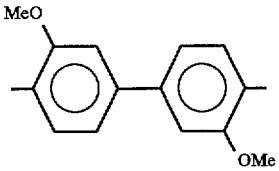 | H | 4-Me | 3 | 1 | T-2 |
| 27 | 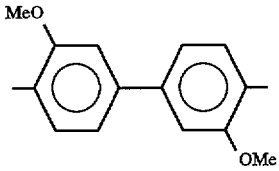 | H | 4-Ph | 3 | 1 | T-2 |
| 28 | 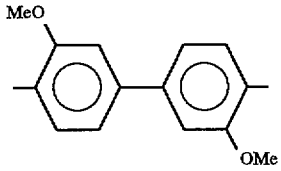 | 3-Me | 4-Me | 3 | 1 | T-8l |
TABLE 3
| Compound number | X | $R^1$ | $R^2$ | Position for bonding | k | T |
|---|---|---|---|---|---|---|
| 29 | 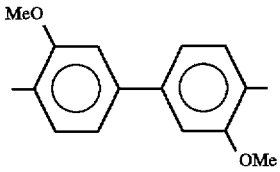 | 3-Me | 4-Me | 3 | 1 | T-25l |
| 30 | 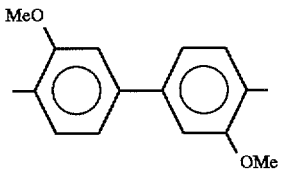 | H | H | 4 | 1 | T-5r |

TABLE 3-continued
| Compound number | X | $R^1$ | $R^2$ | Position for bonding | k | T |
|---|---|---|---|---|---|---|
| 31 | 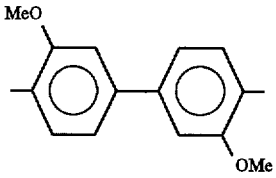 | 3-Me | 4-Me | 4 | 1 | T-2 |
| 32 | 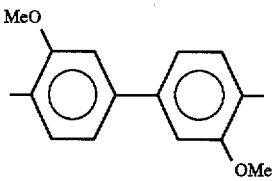 | 4-Me | H | 4 | 1 | T-171 |
| 33 | 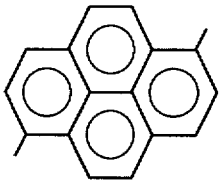 | H | H | 3 | 1 | T-2 |
| 34 | 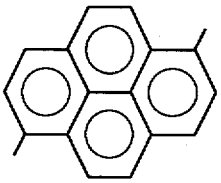 | H | 4-Me | 3 | 1 | T-81 |
| 35 | 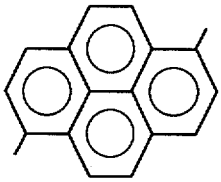 | 3-Me | 4-Me | 3 | 1 | T-181 |
| 36 | 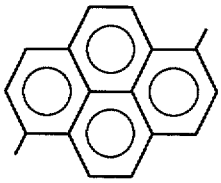 | H | H | 4 | 1 | T-201 |
| 37 | 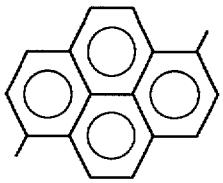 | 4-Me | H | 4 | 1 | T-241 |
| 38 | 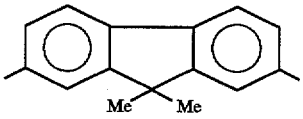 | H | H | 3 | 1 | T-2 |

TABLE 3-continued
| Compound number | X | $R^1$ | $R^2$ | Position for bonding | k | T |
|---|---|---|---|---|---|---|
| 39 | 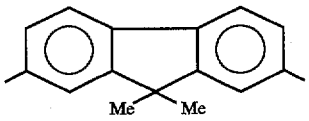 | H | 4-Me | 3 | 1 | T-81 |
| 40 | 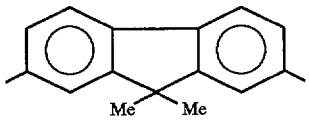 | 3-Me | 4-Me | 3 | 1 | T-181 |
| 41 | 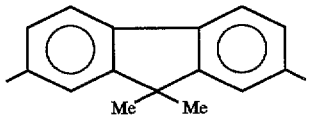 | H | H | 4 | 1 | T-201 |
| 42 | 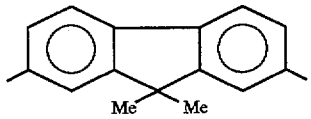 | 4-Me | H | 4 | 1 | T-241 |
TABLE 4
General formula (I-2)
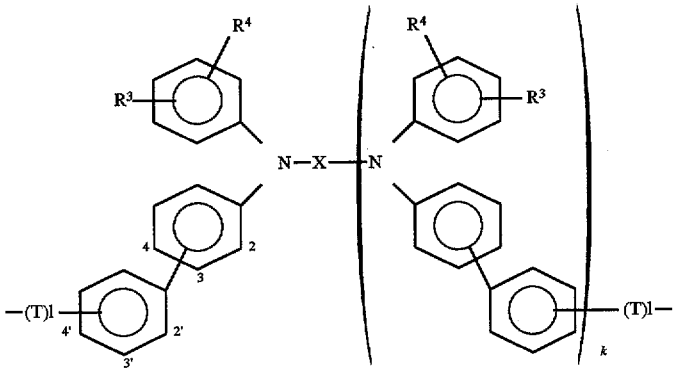
| Compound number | X | $R^3$ | $R^4$ | Position for bonding | k | T |
|---|---|---|---|---|---|---|
| 43 | 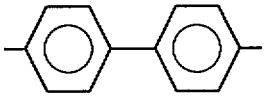 | H | H | 4,4' | 0 | T-1 |
| 44 | 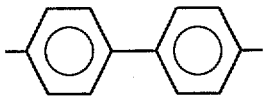 | H | H | 4,4' | 0 | T-2 |
| 45 | 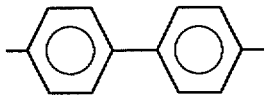 | 3-Me | 4-Me | 4,4' | 0 | — |

TABLE 4-continued
General formula (I-2)
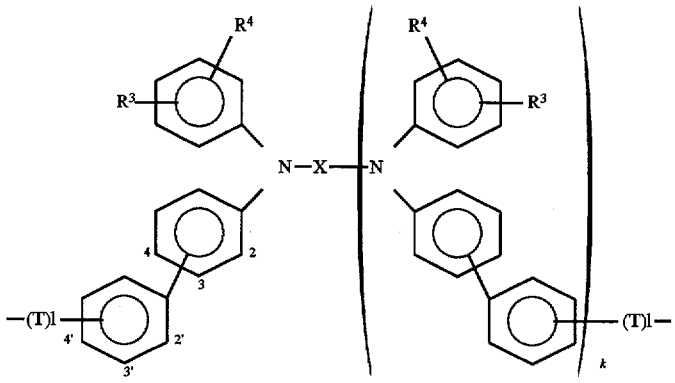
| Compound number | X | $R^3$ | $R^4$ | Position for bonding | k | T |
|---|---|---|---|---|---|---|
| 46 | 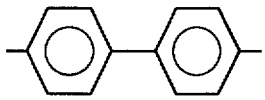 | 3-Me | 4-Me | 4,4' | 0 | T-2 |
| 47 | 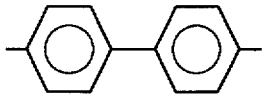 | H | H | 4,4' | 1 | T-1 |
| 48 | 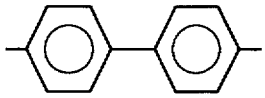 | H | H | 4,4' | 1 | T-2 |
| 49 | 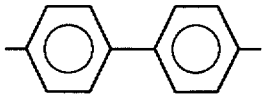 | H | H | 4,4' | 1 | T-5l |
| 50 | 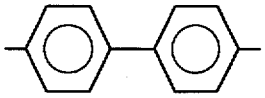 | H | 4-Me | 4,4' | 1 | T-2 |
| 51 | 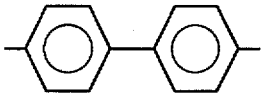 | H | 4-Ph | 4,4' | 1 | T-2 |
| 52 | 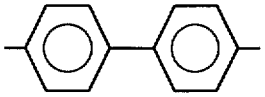 | 3-Me | 4-Me | 4,4' | 1 | T-8l |
| 53 | 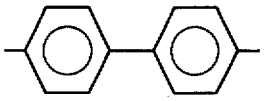 | 3-Me | 4-Me | 4,4' | 1 | T-25l |
| 54 | 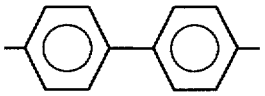 | H | H | 4,4' | 1 | T-5r |
| 55 | 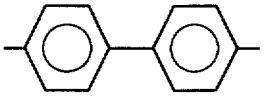 | 3-Me | 4-Me | 4,4' | 1 | T-1 |

TABLE 4-continued
General formula (I-2)
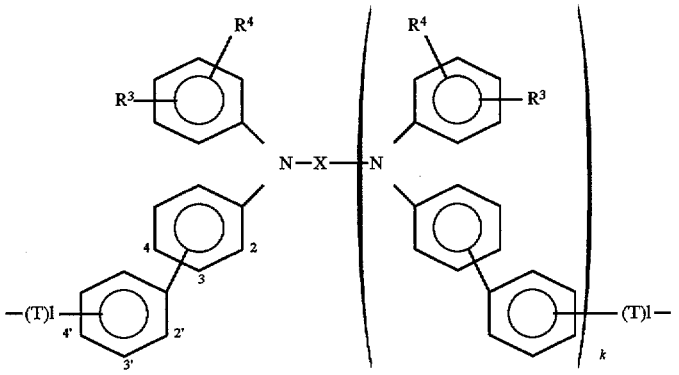
| Compound number | X | $R^3$ | $R^4$ | Position for bonding | k | T |
|---|---|---|---|---|---|---|
| 56 | 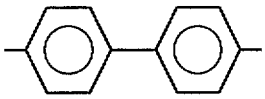 | 4-Me | H | 4,4' | 1 | T-2 |
TABLE 5
| Compound number | X | $R^3$ | $R^4$ | Position for bonding | k | T |
|---|---|---|---|---|---|---|
| 57 | 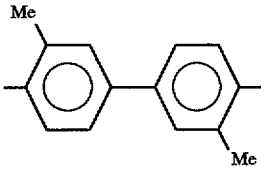 | H | H | 4,4' | 1 | — |
| 58 | 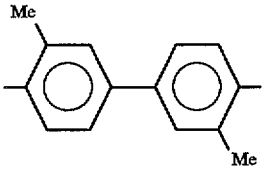 | H | H | 4,4' | 1 | T-2 |
| 59 | 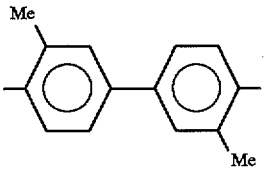 | H | 4-Me | 4,4' | 1 | T-2 |
| 60 | 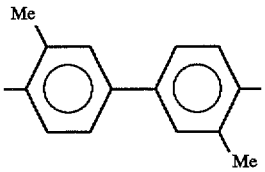 | H | 4-Ph | 4,4' | 1 | T-1 |

TABLE 5-continued
| Compound number | X | $R^3$ | $R^4$ | Position for bonding | k | T |
|---|---|---|---|---|---|---|
| 61 | 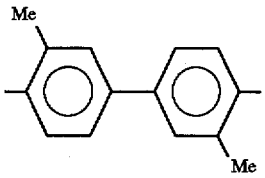 | 3-Me | 4-Me | 4,4' | 1 | T-2 |
| 62 | 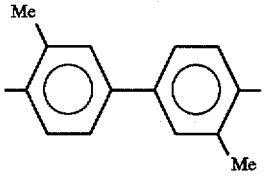 | 3-Me | 4-Me | 4,4' | 1 | T-4 |
| 63 | 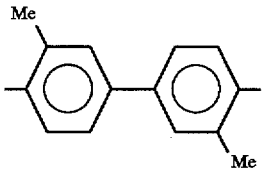 | H | H | 4,4' | 1 | T-5r |
| 64 | 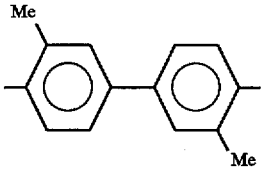 | 3-Me | 4-Me | 4,4' | 1 | T-5l |
| 65 | 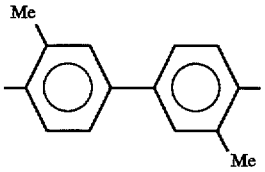 | 4-Me | H | 4,4' | 1 | T-13l |
| 66 | 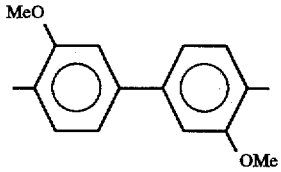 | H | H | 4,4' | 1 | — |
| 67 | 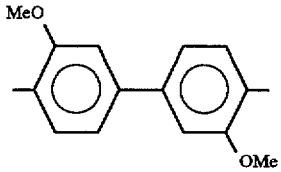 | H | H | 4,4' | 1 | T-2 |
| 68 | 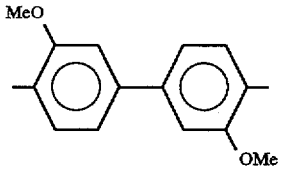 | H | 4-Me | 4,4' | 1 | T-2 |

TABLE 5-continued
| Compound number | X | $R^3$ | $R^4$ | Position for bonding | k | T |
|---|---|---|---|---|---|---|
| 69 | 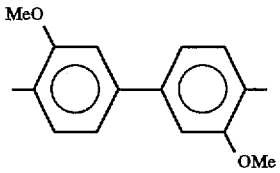 | H | 4-Ph | 4,4' | 1 | T-2 |
| 70 | 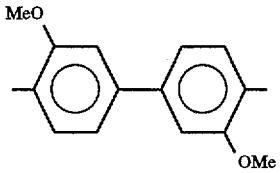 | 3-Me | 4-Me | 4,4' | 1 | T-8l |
TABLE 6
| Compound number | X | $R^3$ | $R^4$ | Position for bonding | k | T |
|---|---|---|---|---|---|---|
| 71 | 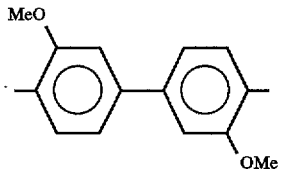 | 3-Me | 4-Me | 4,4' | 1 | T-25l |
| 72 | 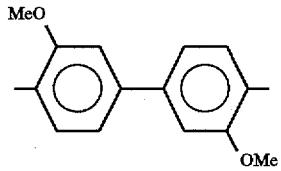 | H | H | 4,4' | 1 | T-5r |
| 73 | 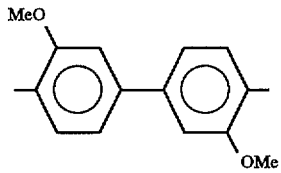 | 3-Me | 4-Me | 4,4' | 1 | T-2 |
| 74 | 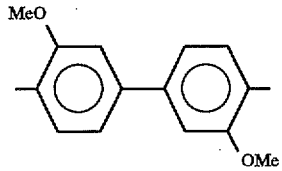 | 4-Me | H | 4,4' | 1 | T-17l |
| 75 | 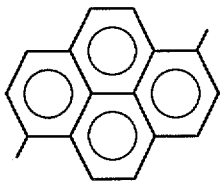 | H | H | 4,4' | 1 | T-2 |

TABLE 6-continued
| Compound number | X | $R^3$ | $R^4$ | Position for bonding | k | T |
|---|---|---|---|---|---|---|
| 76 | 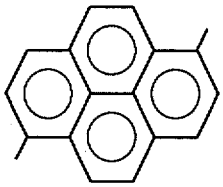 | H | 4-Me | 4,4' | 1 | T-81 |
| 77 | 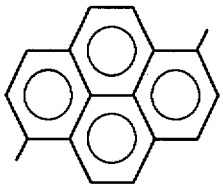 | 3-Me | 4-Me | 4,4' | 1 | T-181 |
| 78 | 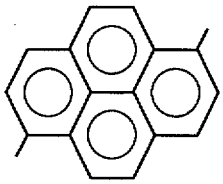 | H | H | 4,4' | 1 | T-201 |
| 79 | 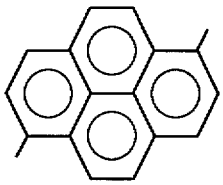 | 4-Me | H | 4,4' | 1 | T-241 |
| 80 | 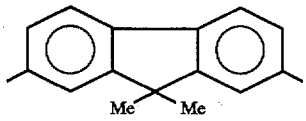 | H | H | 4,4' | 1 | T-2 |
| 81 | 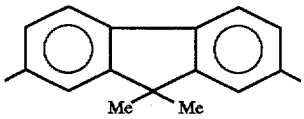 | H | 4-Me | 4,4' | 1 | T-81 |
| 82 | 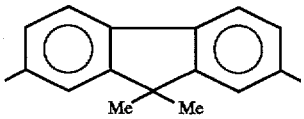 | 3-Me | 4-Me | 4,4' | 1 | T-181 |
| 83 | 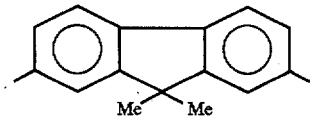 | H | H | 4,4' | 1 | T-201 |
| 84 | 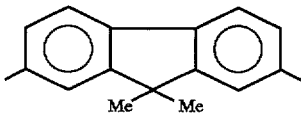 | 4-Me | H | 4,4' | 1 | T-241 |

TABLE 7

General formula (II)
$\text{+CO—A—CO—O—(Y—O)}_m\text{+}_p$

| Compound number | Partial constitution (constitution) | (Ratio) | Y | m | p |
|---|---|---|---|---|---|
| 85 | 6 | — | $-CH_2CH_2-$ | 1 | 165 |
| 86 | 6 | — | $-CH_2CH_2-$ | 2 | 55 |
| 87 | 6 | — | 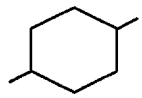 | 1 | 35 |
| 88 | 6 | — | 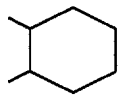 | 1 | 40 |
| 89 | 6 | — | 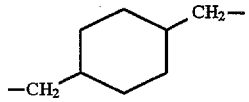 | 1 | 30 |
| 90 | 3 | — | $-CH_2CH_2-$ | 1 | 230 |
| 91 | 19 | — | $-CH_2CH_2-$ | 1 | 165 |
| 92 | 21 | — | $-CH_2CH_2-$ | 1 | 150 |
| 93 | 26 | — | $-CH_2CH_2-$ | 1 | 200 |
| 94 | 33 | — | $-CH_2CH_2-$ | 2 | 60 |
| 95 | 39 | — | $-CH_2CH_2-$ | 1 | 145 |
| 97 | 46 | — | $-CH_2CH_2-$ | 1 | 210 |
| 98 | 47 | — | $-CH_2CH_2-$ | 1 | 140 |
| 99 | 48 | — | $-CH_2CH_2-$ | 1 | 150 |
| 100 | 61 | — | $-CH_2CH_2-$ | 1 | 175 |
| 101 | 58 | — | $-CH_2CH_2-$ | 1 | 175 |
| 102 | 73 | — | $-CH_2CH_2-$ | 1 | 180 |
| 103 | 6/19 | 1/1 | $-CH_2CH_2-$ | 1 | 200 |
| 104 | 6/48 | 1/1 | $-CH_2CH_2-$ | 1 | 170 |
| 105 | 22/47 | 1/1 | $-CH_2CH_2-$ | 1 | 160 |
| 106 | 22/48 | 1/1 | $-CH_2CH_2-$ | 1 | 155 |
| 107 | 22/75 | 1/1 | $-CH_2CH_2-$ | 1 | 180 |

40

TABLE 8

General formula (III)
$\text{+CO—A—CO—O—(Y—O)}_{m2}\text{—CO—Z—CO—O—(Y—O)}_{m2}\text{+}_{p2}$

| Compound number | Partial constitution Constitution | Ratio | Y | Z | $m^2$ | $p^2$ |
|---|---|---|---|---|---|---|
| 108 | 6 | — | $-CH_2CH_2-$ | 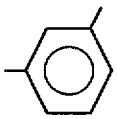 | 1 | 20 |
| 109 | 6 | — | $-CH_2CH_2-$ | 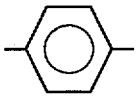 | 1 | 15 |
| 110 | 19 | — | $-CH_2CH_2-$ | 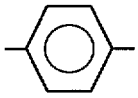 | 1 | 35 |
| 112 | 19 | — | $-CH_2CH_2-$ | $-CH_2CH_2-$ | 1 | 45 |

TABLE 8-continued

General formula (III)
$\text{+CO—A—CO—O—(Y—O)}_{m2}\text{—CO—Z—CO—O—(Y—O)}_{m2}\text{+}_{p2}$

| Compound number | Partial constitution Constitution | Ratio | Y | Z | $m^2$ | $p^2$ |
|---|---|---|---|---|---|---|
| 113 | 19 | — | 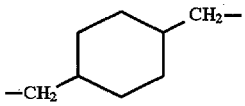 | 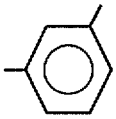 | 1 | 20 |
| 114 | 48 | — | $-CH_2CH_2-$ | 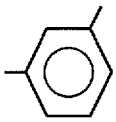 | 1 | 15 |

TABLE 9

General formula (IV)
$\text{+O—A—O—CO—(B—CO)}_{n}\text{+}_{p3}$

| Compound number | Partial constitution Constitution | Ratio | B | n | $p^3$ |
|---|---|---|---|---|---|
| 115 | 5 | — | $-O-CH_2CH_2-O-$ | 1 | 155 |
| 116 | 5 | — | $-O-(CH_2CH_2-O)_2-$ | 1 | 190 |
| 117 | 5 | — | $-CH_2CH_2-$ | 1 | 145 |
| 118 | 5 | — | $-(CH_2)_8-$ | 1 | 155 |
| 119 | 15 | — | $-O-(CH_2CH_2-O)_2-$ | 1 | 155 |
| 120 | 19 | — | — | 0 | 70 |
| 121 | 20 | — | — | 0 | 60 |

A detailed description will be given hereinafter of the general formulae (I-1) and (I-2) which show the structures of the electric charge transporting polycarbonate resin and the electric charge transporting polyester resin.

General formula (I-1)

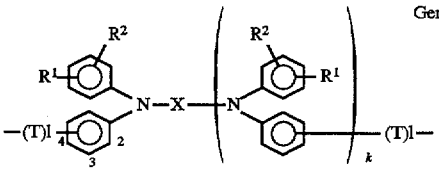

General formula (I-2)

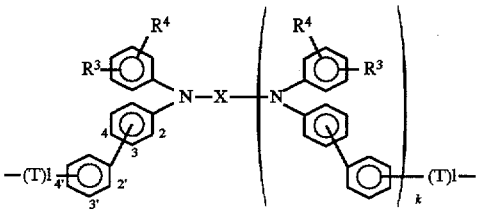

In each of the above-described general formulae, $R^1$ to $R^4$ each independently represents a hydrogen atom, an alkyl group, an alkoxy group, a substituted amino group, a halogen atom, or a substituted or an unsubstituted aryl group, X represents a substituted or an unsubstituted arylene group, k and l each independently represents an integer selected from 0 to 1, and T represents an optionally branched, divalent hydrocarbon (alkylidene or alkylene) group having 1 to 10 carbon atoms, which may be the same or different in each formula. Specific structural examples of T are given below. The aryl-amine skeleton may be linked to any of two sides of each structure. For example, T-2r means the structure which has the aryl-amine skeleton linked to the right side of T-2 structure and T-21 means the structure which has the aryl-amine skeleton linked to the left side of T-2 structure.

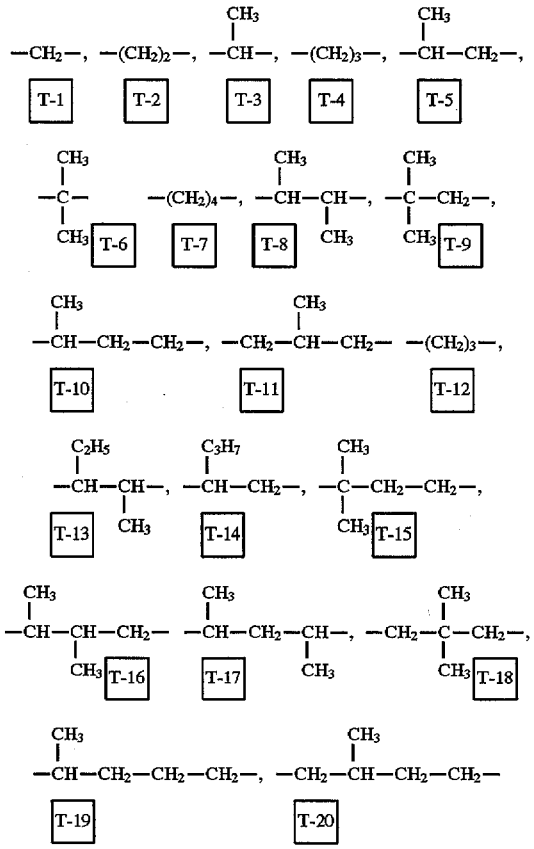

-continued

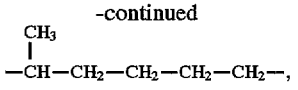

T-21

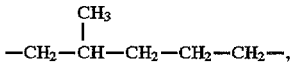

T-22

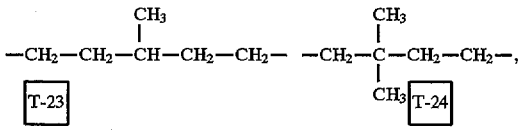

T-23 T-24

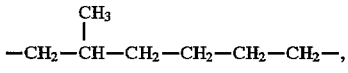

T-25

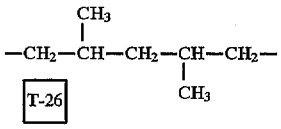

T-26

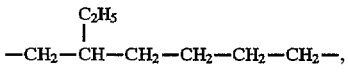

T-27

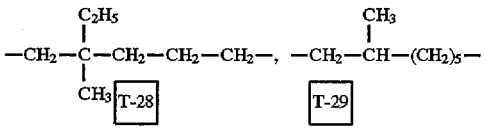

T-28 T-29

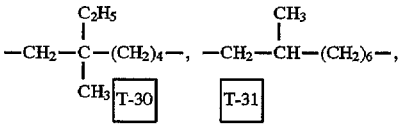

T-30 T-31

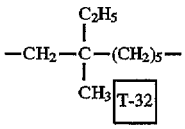

T-32

Further, in the above-described general formulae (I-1) and (I-2), the polymer in which X has a biphenyl structure represented by the following constitutional formulae (V) and (VI) has a high mobility as reported by "The Sixth International Congress on Advances in Non-impact Printing Technologies"(page 306, 1990), and therefore, has a high practicality.

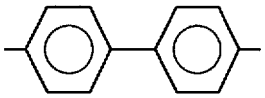

Formula (V)

-continued

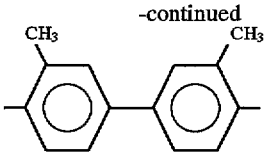

Formula (VI)

Specific examples of X also include the structures of the following general formulae (1) to (7).

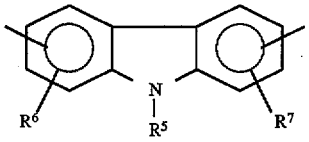

(1)

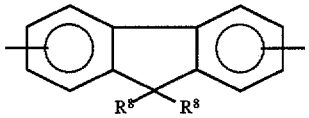

(2)

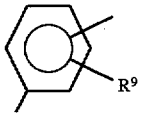

(3)

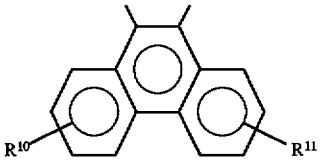

(4)

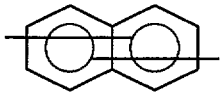

(5)

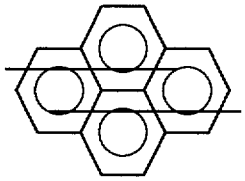

(6)

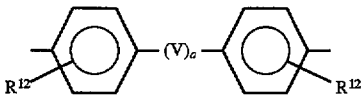

(7)

wherein, $R^5$ represents a hydrogen atom, an alkyl group of 1 to 4 carbon atoms, a substituted or an unsubstituted phenyl group, or a substituted or an unsubstituted aralkyl group, $R^6$ to $R^{12}$ each independently represents a hydrogen atom, an alkyl group of 1 to 4 carbon atoms, an alkoxy group of 1 to 4 carbon atoms, a substituted or an unsubstituted phenyl group, a substituted or an unsubstituted aralkyl group, or a halogen atom, and a is an integer of 1 to 10. Specific examples of V are shown in the following formulae (8) to (17).

$$-(CH_2)_b- \quad (8)$$

$$-C(CH_3)_2- \quad (9)$$

$$-O- \quad (10)$$

$$-S- \quad (11)$$

-continued (12)

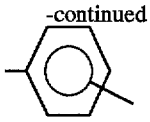

(13)

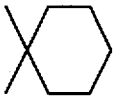

$-C(CF_3)_2-$ (14)

$-Si(CH_3)_2-$ (15)

$-CH=CH-$ (16)

(17)

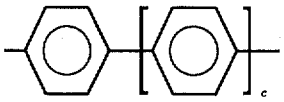

wherein, b is an integer of 1 to 10 and c is an integer of 1 to 3.

A detailed description will be given hereinafter of the general formulae (II), (III) and (IV) which show the structures of the electric charge transporting polycarbonate resin and the electric charge transporting polyester resin.

$$\left[CO-A-CO-O-(Y-O)_{m}\right]_{p} \quad \text{General Formula (II)}$$

General Formula (III)

$$\left[CO-A-CO-O-(Y-O)_{m2}-CO-Z-CO-O-(Y-O)_{m2}\right]_{p2}$$

$$\left[O-A-O-CO-(B-CO)_{n}\right]_{p3} \quad \text{General Formula (IV)}$$

wherein A represents the structure represented by the general formula (I-1) or (I-2); B represents $-O-(Y^2O)_{m'}$ or $-Z^2-$; Y and $Y^2$ represent divalent hydrocarbon groups; Z and $Z^2$ represent divalent hydrocarbon groups; m, $m^2$ and m' each represents an integer of 1 to 5; n represents an integer selected from 0 and 1; and p, $p^2$ and $p^3$ each represents an integer of 5 to 5000.

Specific examples of Y and Z are shown in the following general formulae (18) to (24).

$-(CH_2)_d-$ (18)

$-CH_2CH_2O)_e-(CH_2CH_2)-$ (19)

(20)

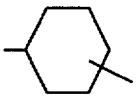

(21)

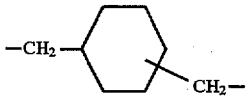

(22)

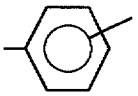

(23)

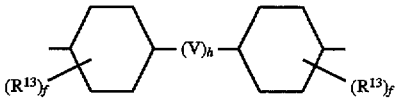

-continued (24)

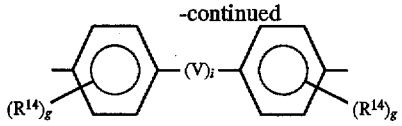

wherein $R^{13}$ and $R^{14}$ each independently represents an hydrogen atom, an alkyl group of 1 to 4 carbon atoms, an alkoxy group of 1 to 4 carbon atoms, a substituted or an unsubstituted phenyl group, a substituted or an unsubstituted aralkyl group or a halogen atom, d and e are each an integer of 1 to 10, f and g are each an integer of 0 to 2, and h and i are each an integer of 0 or 1. V is selected from the structures shown in the general formulae (8) to (17).

In the photoreceptor of the present invention, when the surface layer is used as the electric charge transporting layer, the electric charge transporting polycarbonate resin or the electric charge transporting polyester resin may be used alone, or the mixture of the electric charge transporting polycarbonate resin and the electric charge transporting polyester resin may be used, or the mixture of the electric charge transporting polycarbonate resin or the electric charge transporting polyester resin and the low molecular weight electric charge transporting material may be used. The electric charge transporting polycarbonate resin and the electric charge transporting polyester resin can be used in any blending ratio when mixed. On the other hand, in the case in which these resins are used together with the low molecular weight electric charge transporting material, as the weight of the electric charge transporting material is too much, the wear resistance deteriorates. For this reason, the blending ratio of the electric charge transporting resins to the electric charge transporting materials is set in the range of 99:1 to 30:70, and preferably 95:5 to 40:60. Examples of the low molecular weight electric charge transporting materials to be used together include publicly-known materials such as hydrazones, triarylamines, and stilbenes. The appropriate thickness of the surface layer is set in the range of 5 to 50 μm, preferably 10 to 35 μm in any case.

The coating methods of the electric charge transporting layer include blade coating, wire bar coating, spray coating, dip coating, bead coating, air knife coating, curtain coating and the like. Examples of a solvent to be used for coating include dioxane, tetrahydrofuran, methylenechloride, chloroform, chlorobenzene, toluene and the like. These solvents may be used alone or in combination of two or more of them.

When the surface layer of the present invention is used as the protective layer, the protective layer having the composition of any one of the above-described combinations is formed on an electric charge transporting layer formed by using the publicly-known binder resin, and hydrazone-based electric charge transporting material, triarylamine-based electric charge transporting material, or stilbene-based electric charge transporting material, on an electric charge generating layer formed with the pigments dispersed in the publicly-known binder resin, or on an electric charge generating/electric charge transporting layer formed by using the publicly-known electric charge generating/electric charge transporting material or the publicly-known electric charge generating material and electric charge transporting material. The thickness of the protective layer is set in the range of 1 to 20 μm, preferably in the range of 2 to 10 μm. The coating methods of the protective layer include blade coating, wire bar coating, spray coating, dip coating, bead coating, air knife coating, curtain coating, and the like. Examples of a solvent to be used for coating include dioxane, tetrahydrofuran, methylenechloride, chloroform, chlorobenzene, toluene, and the like. These solvents may be used alone or in combination of two or more of them. Further, it is preferable to use a solvent which is not apt to dissolve an underlying layer.

When the surface layer of the photoreceptor of the present invention is used as a photosensitive layer of a single-layered photoreceptor, the publicly-known electric charge generating materials such as anthrone pigments, azo pigments, perylene pigments, and phthalocyanine pigments are also used in addition to the electric charge transporting materials such as the above electric charge transporting resins and low molecular weight electric charge transporting materials. The ratio by weight of the electric charge transporting materials to the electric charge generating material is set in the range of 99:1 to 50:50, preferably in the range of 95:5 to 60:40. The thickness of the surface layer used as the photosensitive layer of the single-layered photoreceptor is set in the range of 5 to 50 μm, preferably 10 to 40 μm. The coating methods of the photosensitive layer of the single-layered photoreceptor include blade coating, wire bar coating, spray coating, dip coating, bead coating, air knife coating, curtain coating, and the like. Examples of a solvent to be used for coating include dioxane, tetrahydrofuran, methylenechloride, chloroform, chlorobenzene, toluene, and the like. These solvents may be used alone or in combination of two or more of them.

Further, in order to prevent deterioration of the photoreceptor, which is caused by ozone or oxidized gas generated in the copying machine, or by light or heat, additives such as an antioxidant, photostabilizer, or thermostabilizer can be added to the photosensitive layer. Examples of the antioxidant include hindered phenol, hindered amine, paraphenylenediamine, arylalkane, hydroquinone, spirochroman, spiroindanone, derivatives thereof, organosulfur compounds and organophosphorus compounds. Examples of the photostabilizer include derivatives of benzophenone, benzotriazole, dithiocarbamate and tetramethylpyperidine. Further, for the purpose of increasing sensitivity, decreasing residual potential, decreasing fatigue due to repetitive use, and the like, at least one kind of electron accepting materials can be incorporated into the photosensitive layer. The examples of the electron accepting materials which can be used in the photoreceptor of the present invention include succinic arthydride, maleic arthydride, dibromomaleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitrofluorenone, pierio acid, o-nitrobenzoic acid, p-nitrobenzoic acid and phthalic acid. Of these compounds, particularly preferred are fluorenone-, quintone-compounds, and benzene derivatives which have electron attracting substituents such as Cl, CN, and $NO_2$.

The electrophotographic photoreceptor of the present invention exhibits excellent properties when used not only with a conventional corona-charging member, but also with a contact-charging member. The contact-charging member is disposed so as to be brought into contact with the surface of the photoreceptor so that voltage can be directly and uniformly applied to the photoreceptor, thereby the surface of the photoreceptor being electrically charged to have a predetermined potential. Examples of the contact-charging member include metals such as aluminium, iron, and copper; conductive polymeric materials such as polyacetylene, polypyrrole, and polythiophene; and elastomeric materials such as polyurethane rubber, silicone rubber, epichlorohydrin rubber, ethylenepropylene rubber, acrylic rubber, fluororubber, styrene-butadiene rubber, or butadiene rubber, with conductive particles such as carbon black, copper iodide, silver iodide, zinc sulfide, silicon carbide, or metallic oxide being dispersed therein. Examples of the metallic oxide include ZzO, $SnO_2$, $TIC_2$, $In_2O_3$, $MoO_3$, or composite oxides thereof. Further, the elastomeric material may contain perchlorate to provide conductivity. Moreover, a coating layer may also be formed on the surface of the photoreceptor. Examples of the materials for forming the coating layer include N-alkoxymethylated nylon, cellulose resins, vinylpyridine resins, phenol resins, polyurethane, polyvinylbutyral, melamine, and the like. These materials may be used alone or in combination of two or more of them. Further, emulsion resin materials such as acrylic resin emulsion, polyester resin emulsion, polyurethane, especially, an emulsion resin synthesized by polymerization of soap-free emulsion can also be used. In order to further adjust resistivity, conductive particles may also be dispersed in these resins, and in order to prevent deterioration, an antioxidant may also be contained. Further, in order to improve film-forming properties at the time of formation of the coating layer, a leveling agent or surface active agent may also be contained in the emulsion resin.

The contact-charging member can have any of various shapes of roller, blade, belt, blush, and the like. Further, the resistivity of the contact-charging member is preferably set in the range of $10^0$ to $10^{14}$ Ωcm, and more preferably $10^2$ to $10^{12}$ Ωcm. Further, as an applied voltage for the contact-charging member, either a direct current voltage or an alternating current voltage can be used. Alternatively, the applied voltage may also be provided in the form of a direct current voltage plus an alternating current voltage.

EXAMPLES

The present invention will be further explained by way of examples below, but is not limited to these examples.

In the following examples, "parts" means parts by weight and "%" means percentage by weight unless otherwise provided.

(Example 1)

Formation of undercoating layer 8 parts of dibromoanthanthrone (trade name:MONOLITE RED 2Y available from Zeneca) represented by the following constitutional formula (VII), 1 part of a polyvinyl butyral resin (trade name:S-LEG BM-1 available from Sekisui Chemical Co., LTD.) and 20 parts of cyclohexanone were mixed together and stirred to be dispersed by a paint shaker for one hour together with glass beads. Added to the resultant coating liquid was 1 part of acetylacetone zirconium butylate (trade name: ZC540 available from MATSUMOTO SEIYAKU), which was stirred to be dispersed by a paint shaker for 10 minutes. The resultant coating liquid was applied, by a dip coating method, onto an aluminium pipe subjected to honing process and serving as a substrate and was dried at 170° C. for 10 minutes to form an undercoating layer having a coating thickness of 3.0 μm.

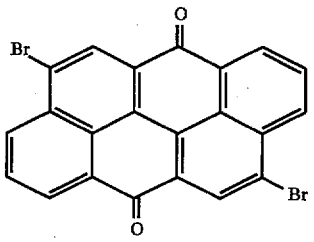

Formula (VII)

Formation of electric charge generating layer

Figure 5:
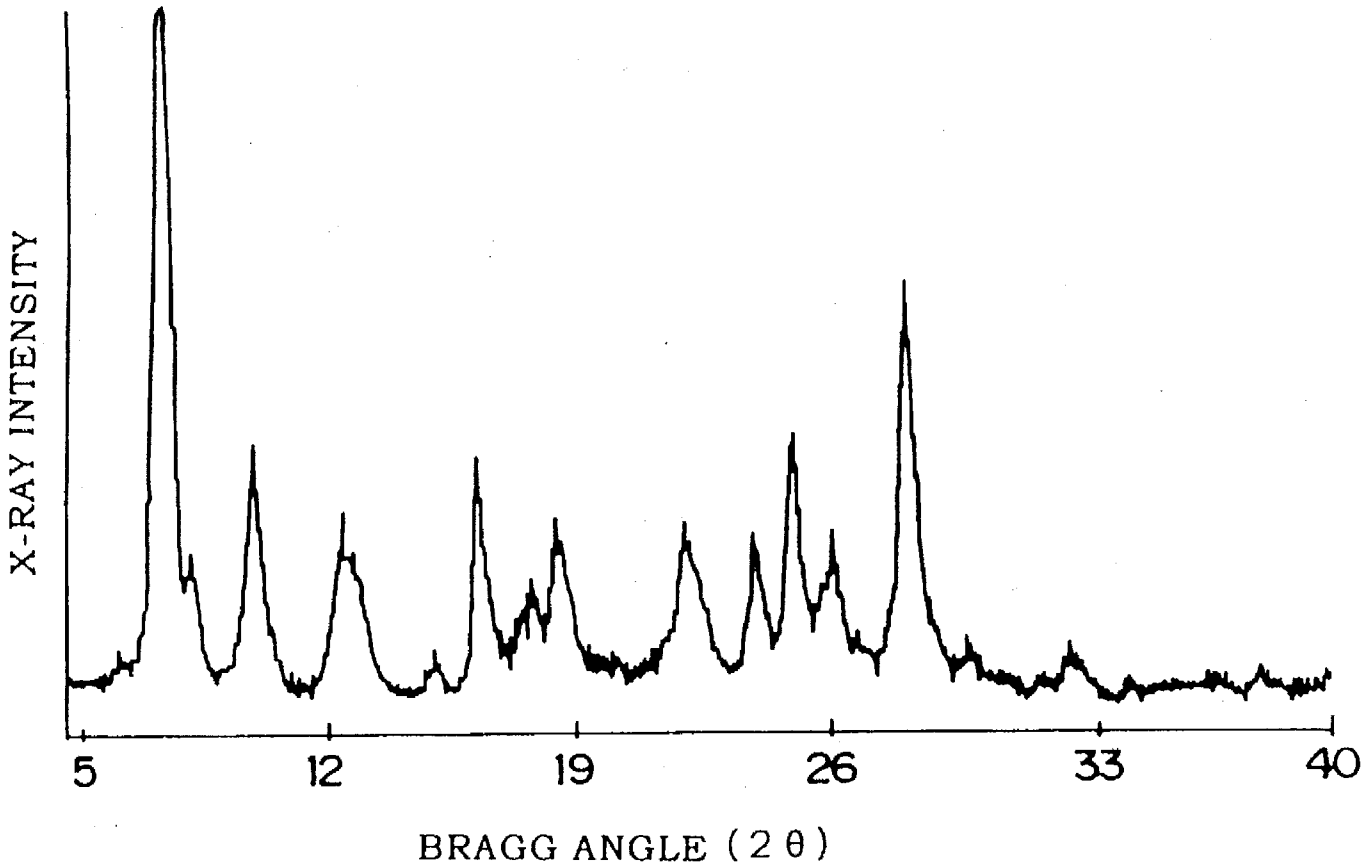
FIG. 5 is a graph illustrating an X-ray diffraction pattern of a powder of hydroxygallium phthalocyanine crystals used in Example 1.

Subsequently, a mixture comprising 0.1 part of hydroxygallium phthalocyanine having the X-ray diffraction pattern as shown in FIG. 5, 0.1 part of the polyvinyl butyral resin (trade name:S-LEG BM-1 available from Sekisui Chemical Co., LTD.) and 10 parts of n-butyl acetate was dispersed together with glass beads for one hour by a paint shaker. The resultant coating liquid was applied onto the above undercoating layer by a dip coating method, and dried at 100° C. for 10 minutes to form an electric charge generating layer having a film coating thickness of approximately 0.15 μm. Further, it was confirmed that the crystal form of the dispersed hydroxygallium phthalocyanine did not change by the X-ray diffraction as compared with that prior to the dispersion.

Formation of surface layer

Example of synthesis 1: Synthesis of electric charge transporting polyester [compound (90)]

In a flask of 200 ml, 8.0 g of N,N'-bis[3-(2-ethoxycarbonylethyl)phenyl]- 3,4-xylidine, 20.0 g of ethylene glycol and 0.1 g of tetrabutoxy titanium were mixed together and heat-refluxed for three hours under the flow of nitrogen. After it was confirmed that N,N'-bis[3-(2-ethoxycarbonylethyl)phenyl]-3,4-xylidine was exhausted, the reaction pressure was reduced to 0.5 mmHg and the resultant mixture was heated to 230° C. while ethylene glycol being removed, and this reaction was continued for three hours. Thereafter, the resultant mixture was cooled to a room temperature and was dissolved in 100 ml of THF. After filtration of insoluble matters, the resultant filtrate was dropped into 1,000 ml of water which was stirred to obtain a polymer. The polymer thus obtained was sufficiently rinsed with water and dried to obtain 7.2 g of electric charge transporting polyester. The weight-average molecular weight (Mw) of this polymer measured by GPC was $1.05\times 10^5$ (conversion in styrene, the degree of polymerization p=approximately 230).

5 parts of the electric charge transporting polymer (90) was dissolved into 38 parts of monochlorobenzene. The resultant coating liquid was applied, by the dip coating method, onto the charge electric generating layer formed on the aluminium pipe-shaped substrate and was dried at 120° C. for one hour to form an electric charge transporting layer having a coating thickness of 15 μm.

The electrophotographic photoreceptor thus obtained was tested by using a laser printer-modified scanner (XP-15, modified, available from Fuji Xerox) to determine the electrophotographic properties thereof as follows. Each electric potential of respective portions was measured, under the environment of an ordinary temperature and humidity (20° C., 40% RH) (1), after each of the following processes was carried out: (A) charging the photoreceptor by a SCOROTRON charging device having 700 V of grid applied voltage; (B) after one second, applying light of 10.0 erg/cm$^2$ to the photoreceptor by a semiconductor laser of 780 nm in order to discharge charges; and (C) after three seconds, applying red-color LED light of 50.0 erg/cm$^2$ to the photoreceptor in order to remove residual potential. The higher the potential VH measured after process (A) becomes, the higher the accepting potential of the photoreceptor becomes. The higher accepting potential allows higher contrast. The lower the potential VL measured after process (B) becomes, the higher the sensitivity of the photoreceptor becomes. The lower the potential VRP measured after process (C) becomes, the lower the residual potential becomes. The lower residual potential allows a lower capacity of image memory and a reduced fog. Further, after repeating 10,000 charging and exposing, the potential of each portion was also measured. Moreover, this measurement was also made in other environments: (2) a low temperature and low humidity (10° C., 15% RH); and (3) a high temperature and high humidity (28° C., 85% RH), and amounts of changes in potential of each portion between the environments (1) through (3), i.e., ΔVH, ΔVL and ΔVRP, were measured to estimate the stability even in light of changes in the environment (stability with respect to environment). Further, with the electrophotographic photoreceptor being mounted in a printer for a personal computer (trade name: PR1000 available from NEC Corp.), an endurance test of 10,000 printing was carried out in each of the environments of: an ordinary temperature and ordinary humidity (20° C., 40% RH); a low temperature and low humidity (10° C., 15% RH); and a high temperature and high humidity (28° C., 85% RH) to estimate image qualities. At this time, the estimation was effected in each of the cases of using either SCOROTRON charging member or roll-type charging member. Here, the roll-type charging member was comprised of a stainless-steel (5 mmϕ×18.8 mm) with an elastic layer and a resin layer provided on an outer periphery of the shaft. Namely, an elastic layer comprising polyether-based polyurethane rubber having an elasticity with 0.5% of lithium perchlorate added, was formed on an outer periphery of the shaft so that the outer diameter thereof became 15 mmϕ. Applied by the dip coating method onto the surface of the elastic layer was a coating liquid comprising a polyester-based polyurethane emulsion resin solution with 0.001% of a methylphenyl silicone leveling agent added thereto. The coating liquid was dried at 120° C. for 20 minutes to form a coating layer having a film thickness of 20 μm. The results are shown in Table 10.

(Example 2)

An electrophotographic photoreceptor was prepared and a similar test was conducted as in Example 1 except that as an electric charge transporting material, a mixture of benzimidazole perylene pigments represented by the following constitutional formulae (VIII) and (IX) was used for the undercoating layer. The results are shown in Table 10.

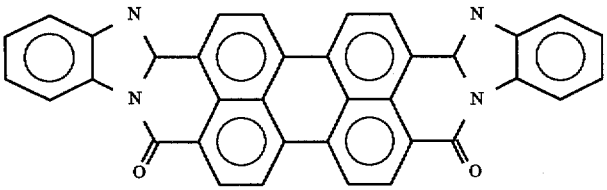

Formula (VIII)

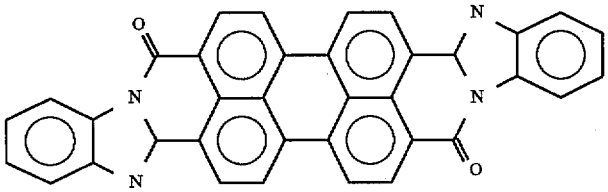

Formula (IX)

(Example 3)

An electrophotographic photoreceptor was prepared and a similar test was conducted as in Example 1 except that as an electric charge transporting material, phthalocyanine pigments represented by the following constitutional formula (X) was used for the undercoating layer. The results are shown in Table 10.

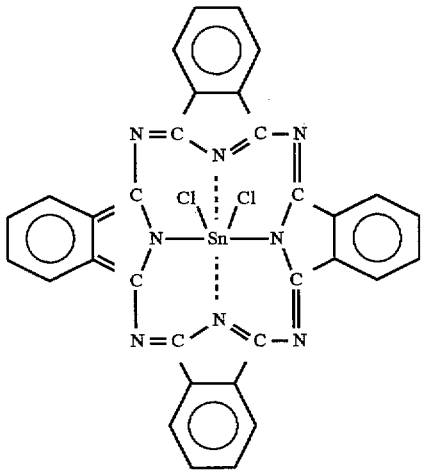

(Example 4)

An electrophotographic photoreceptor was prepared and a similar test was conducted as in Example 1 except that as an electric charge transporting material, a bis-azo pigment represented by the following constitutional formula (XI) was used for the undercoating layer. The results are shown in Table 10.

(Example 5)

An electrophotographic photoreceptor was prepared and a similar test was conducted as in Example 1 except that as an electric charge transporting material, a perylene pigment represented by the following constitutional formula (XIV) was used for the undercoating layer. The results are shown in Table 10.

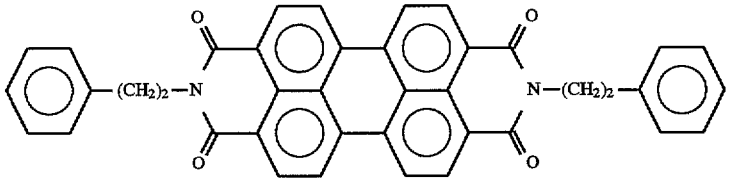

Formula (XIV)

(Example 6)

Example of synthesis 2: Synthesis of electric charge transporting polyester [compound (85)]

In a flask of 200 ml, 10.0 g of N,N'-diphenyl-N,N'-bis[3-(2-ethoxycarbonylethyl)phenyl]-[1,1'-biphenyl]-4,4'-diamine, 20.0 g of ethylene glycol and 0.1 g of tetrabutoxy titanium were mixed together and heat-refluxed under the flow of nitrogen for three hours. After it was confirmed that N,N'-diphenyl-N,N'-bis [3-(2-ethoxycarbonylethyl)phenyl]-[1,1'-biphenyl]-4,4'-diamine was exhausted, the reaction pressure was reduced to 0.5 mmHg and the resultant mixture was heated to 230° C. while ethylene glycol being removed, and this reaction was continued for three hours. Thereafter, the resultant mixture was cooled to a room temperature and was dissolved in 100 ml of methylene chloride. After filtration of insoluble matters, the resultant filtrate was dropped into 1,000 ml of acetone which was stirred to obtain a polymer. The polymer thus obtained was sufficiently rinsed with water and dried to obtain 8.4 g of electric charge transporting polyester. The Mw of this polymer measured by GPC was $1.10\times10^5$ (conversion in styrene, the degree of polymerization p=approximately 165).

An electrophotographic photoreceptor was prepared and a similar test was conducted as in Example 1 except that the electric charge transporting polymer (85) was used for the surface layer. The results are shown in Table 10.

(Example 7)

Example of synthesis 3: Synthesis of electric charge transporting polyester [compound (108)]

In a flask of 500 ml, 10.0 g of N,N'-diphenyl-N,N'-bis[3-(2-ethoxycarbonylethyl)phenyl]-[1,1'-biphenyl]-4,4'-diamine, 20.0 g of ethylene glycol and 0.1 g of tetrabutoxy titanium were mixed together and heat-refluxed for three hours under the flow of nitrogen. After is was been confirmed that N,N'-diphenyl-N,N'-bis [3-(2-ethoxycarbonylethyl)phenyl]-[1,1'-biphenyl]-4,4'-diamine was exhausted, the reaction pressure was reduced to 0.5 mmHg and ethylene glycol was removed. Thereafter, the resulting mixture was cooled to a room temperature and was dissolved in 200 ml of methylene chloride, and a solution with 3.0 g of isophthalic acid dichloride being dissolved in 100 ml of methylene chloride was dropped into the mixture. Added to the resultant mixture was 6.1 g of triethylamine and the mixture was heat-refluxed for 30 minutes. Further, added to the mixture was 3 ml of methanol, and the mixture was heat-refluxed for 30 minutes. Thereafter, a filtrate obtained after filtration of insoluble matters was dropped into 1,000 ml of ethanol which was stirred to obtain a polymer. The polymer thus obtained was sufficiently rinsed with ethanol and dried to obtain 6.1 g of electric charge transporting polyester. The Mw of this polymer measured by GPC was $1.70\times10^4$ (conversion in styrene, the degree of polymerization p=approximately 20).

An electrophotographic photoreceptor was prepared and a similar test was conducted as in Example 1 except that the electric charge transporting polymer (108) was used for the surface layer. The results are shown in Table 10.

(Example 8)

Example of synthesis 4: Synthesis of electric charge transporting polyester [compound (87)]

In a flask of 500 ml, 10.0 g of N,N'-diphenyl-N,N'-bis[3-(2-ethoxycarbonylethyl)phenyl]-[1,1'-biphenyl]-4,4'-diamine, 20.0 g of 1,4-cyclohexanediole (cis-trans mixture) and 0.1 g of tetrabutoxy titanium were mixed together and heat-refluxed for two hours under the flow of nitrogen. After is was confirmed that N,N'-diphenyl-N,N'-bis [3-(2-ethoxycarbonylethyl)phenyl]-[1,1'-biphenyl]-4,4'-diamine was exhausted, the reaction pressure was reduced to 0.5 mmHg and the mixture was heated to 230° C. while 1,4-cyclohexandiole being removed, and this reaction was continued for five hours. Thereafter, the resultant mixture was cooled to a room temperature and was dissolved in 100 ml of methylene chloride. After filtration of insoluble matters, the resultant filtrate was dropped into 1,000 ml of ethanol which was stirred to obtain a polymer. The polymer thus obtained was sufficiently rinsed with ethanol and water and dried to obtain 8.6 g of electric charge transporting polyester. The Mw of this polymer measured by GPC was $2.80\times10^4$ (conversion in styrene, the degree of polymerization p=approximately 35).

An electrophotographic photoreceptor was prepared and a similar test was conducted as in Example 1 except that the electric charge transporting polymer (87) was used for the surface layer. The results are shown in Table 10.

(Example 9)

Example of synthesis 5: Synthesis of electric charge transporting polyester [compound (89)]

In a flask of 500 ml, 10.0 g of N,N'-diphenyl-N,N'-bis[3-(2-ethoxycarbonylethyl)phenyl]-[1,1'-biphenyl]-4,4'-diamine, 20.0 g of 1,4-cyclohexanedimethanol (cis-trans mixture) and 0.1 g of tetrabutoxy titanium were mixed together and heat-refluxed for two hours under the flow of nitrogen. After it was confirmed that N,N'-diphenyl-N,N'-bis[3-(2-ethoxycarbonylethyl)phenyl]-[1,1'-biphenyl]-4,4'-diamine was exhausted, the reaction pressure was reduced to 0.5 mmHg and the mixture was heated to 230° C. while 1,4-cyclohexandimethanol being removed, and this reaction was continued for four hours. Thereafter, the resultant mixture was cooled to a room temperature and was dissolved in 100 ml of methylene chloride. After filtration of insoluble matters, the resultant filtrate was dropped into 1,000 ml of ethanol which was stirred to obtain a polymer. The polymer thus obtained was sufficiently rinsed with ethanol and water and dried to obtain 8.0 g of electric charge transporting polyester. The Mw of this polymer measured by GPC was $2.40\times10^4$ (conversion in styrene, the degree of polymerization p=approximately 30).

An electrophotographic photoreceptor was prepared and a similar test was conducted as in Example 1 except that the electric charge transporting polymer (89) was used for the surface layer. The results are shown in Table 10.

(Example 10)

Example of synthesis 6: Synthesis of electric charge transporting polyester [compound (91)]

In a flask of 500 ml, 20.0 g of 3,3'-dimethyl-N,N'-bis[3,4-dimethylphenyl]-N, N'-bis[4-(2-methoxycarbonylethyl) phenyl]-[1,1'-biphenyl]-4,4'-diamine, 40.0 g of ethylene glycol and 0.1 g of tetrabutoxy titanium were mixed together and heat-refluxed for three hours under the How of nitrogen. After it was confirmed that 3,3'-dimethyl-N,N'-bis [3,4-dimethylphenyl]-N,N'-bis[4-(2-methoxycarbonylethyl) phenyl]-[1,1'-biphenyl]-4,4'-diamine was exhausted, the reaction pressure was reduced to 0.5 mmHg and the mixture was heated to 230° C. while ethylene glycol being removed, and this reaction was continued for three hours. Thereafter, the resultant mixture was cooled to a room temperature and was dissolved in 200 ml of methylene chloride. After filtration of insoluble matters, the resultant filtrate was dropped into 1,500 ml of ethanol which was stirred to obtain a polymer. The polymer thus obtained was filtered and sufficiently rinsed with ethanol, and then was dried to obtain 19.2 g of electric charge transporting polyester. The Mw of this polymer measured by GPC was $1.21\times10^5$ (conversion in styrene, the degree of polymerization p=approximately 165).

An electrophotographic photoreceptor was prepared and a similar test was conducted as in Example 1 except that the electric charge transporting polymer (91) was used for the surface layer. The results are shown in Table 10.

(Example 11)

Example of synthesis 7: Synthesis of electric charge transporting polyester [compound (97)]

In a flask of 500 ml, 10.0 g of N,N'-bis[4-(4-ethoxycarbonylmethylphethyl) phenyl]-3,4-xylidine, 20.0 g of ethyl glycol and 0.1 g of tetrabutoxy titanium were mixed together and heat-refluxed for two hours under the flow of nitrogen. After it was confirmed that N,N'-bis[4-(4-ethoxycarbonylmethylphethyl)phenyl]-3,4-xylidine was exhausted, the reaction pressure was reduced to 0.5 mmHg and the mixture was heated to 230° C. while ethylene glycol being removed, and this reaction was continued for five hours. Thereafter, the resultant mixture was cooled to a room temperature and was dissolved in 100 ml of methylene chloride. After filtration of insoluble matters, the resultant filtrate was dropped into 1,000 ml of ethanol which was stirred to obtain a polymer. The polymer thus obtained was sufficiently rinsed with ethanol and dried to obtain 8.1 g of electric charge transporting polyester. The Mw of this polymer measured by GPC was $1.21\times10^5$ (conversion in styrene, the degree of polymerization p=approximately 210).

An electrophotographic photoreceptor was prepared and a similar test was conducted as in Example 1 except that the electric charge transporting polymer (97) was used for the surface layer. The results are shown in Table 11.

(Example 12)

Example of synthesis 8: Synthesis of electric charge transporting polyester [compound (98)]

In a flask of 500 ml, 10.0 g of N,N'-diphenyl-N,N'-bis[4-(4-ethoxycarbonylmethylphenyl)-phenyl]-[1,1'-biphenyl]-4,4'-diamine, 20.0 g of ethylene glycol and 0.1 g of tetrabutoxy titanium were mixed together and heat-refluxed for two hours under the flow of nitrogen. After it was confirmed that N,N'-diphenyl-N,N'-bis [4-(4-ethoxycarbonylmethylphenyl)-phenyl]-[1,1'-biphenyl]-4,4'-diamine was exhausted, the reaction pressure was reduced to 0.5 mmHg and the mixture was heated to 230° C. while ethylene glycol being removed, and this reaction was continued for three hours. Thereafter, the resultant mixture was cooled to a room temperature and was dissolved into 100 ml of methylene chloride. After filtration of insoluble matters, the resultant filtrate was dropped into 1,000 ml of ethanol which was stirred to obtain a polymer. The polymer thus obtained was filtered and sufficiently rinsed with ethanol, and then dried to obtain 8.0 g of electric charge transporting polyester. The Mw of this polymer measured by GPC was $1.06\times10^5$ (conversion in styrerie, the degree of polymerization p=approximately 140).

An electrophotographic photoreceptor was prepared and a similar test was conducted as in Example 1 except that the electric charge transporting polymer (98) was used for the surface layer. The results are shown in Table 11.

(Example 13)

Example of synthesis 9: Synthesis of electric charge transporting polyester [compound (99)]

In a flask of 500 ml, 10.0 g of N,N'-diphenyl-N,N'-bis[4-(4-ethoxycarbonylethylphenyl)-phenyl]-[1,1'-biphenyl]-4,4'diamine, 20.0 g of ethylene glycol and 0.1 g of tetrabutoxy titanium were mixed together and heat-refluxed for three hours under the flow of nitrogen. After it was confirmed that N,N'-diphenyl-N,N'-bis [4-(4-ethoxycarbonylethylphenyl)-phenyl]-[1,1'-biphenyl]4,4'-diamine was exhausted, the reaction pressure was reduced to 0.5 mmHg and the mixture was heated to 230° C. while ethylene glycol being removed, and this reaction was continued for three hours. Thereafter, the resultant mixture was cooled to a room temperature and was dissolved in 100 ml of methylene chloride. After filtration of insoluble matters, the resultant filtrate was dropped into 1,000 ml of ethanol which was stirred to obtain a polymer. The polymer thus obtained was filtered and sufficiently rinsed with ethanol, and then dried to obtain 8.6 g of electric charge transporting polyester. The Mw of this polymer measured by GPC was $1.19\times10^5$ (conversion in styrene, the degree of polymerization p=approximately 150).

An electrophotographic photoreceptor was prepared and a similar test was conducted as in Example 1 except that the electric charge transporting polymer (99) was used for the surface layer. The results are shown in Table 11.

(Example 14)

Example of synthesis 10: Synthesis of electric charge transporting polyester [compound (114)]

In a flask of 500 ml, 10.0 g of N,N'-diphenyl-N,N'-bis[4-(4-ethoxycarbonylethylphenyl)-phenyl]-[1,1'-biphenyl]-4,4'-diamine, 20.0 g of ethylene glycol and 0.1 g of tetrabutoxy titanium were mixed together and heat-refluxed for three hours under the flow of nitrogen. After it was confirmed that N,N'-diphenyl-N,N'-bis [4-(4-ethoxycarbonylethylphenyl)-phenyl]-[1,1'-biphenyl]-4,4'-diamine was exhausted, the reaction pressure was reduced to 0.5 mmHg and the mixture was heated to 230° C. and ethylene glycol was removed. Thereafter, the resultant mixture was cooled to a room temperature and was dissolved in 100 ml of methylene chloride, and a solution with 2.4 g of isophthalic acid dichloride dissolved in 10 ml of methylene chloride was dropped into the mixture. In addition, added to the mixture was 4.8 g of triethylamine, and the mixture was heat-refluxed for 30 minutes. Also added to the mixture was 3 ml of methanol, and the mixture was further heat-refluxed for 30 minutes. Thereafter, insoluble matters was filtered and a filtrate was dropped into 1,000 ml of ethanol which was stirred, and the a polymer was obtained. The polymer thus obtained was filtered and was sufficiently washed with ethanol, and then was dried to obtain 9.5 g of electric charge transporting polyester. The Mw of this polymer measured by GPC was $1.33\times10^4$ (conversion in styrene, the degree of polymerization p=approximately 15).

An electrophotographic photoreceptor was prepared and a similar test was conducted as in Example 1 except that the electric charge transporting polymer (114) was used for the surface layer. The results are shown in Table 11.

(Example 15)

Example of synthesis 11: Synthesis of electric charge transporting polyester [compound (116)]

10.0 g of N,N'-diphenyl-N,N'-bis[3-hydroxypheyl]-[1,1'-biphenyl]-4,4'-diamine, 100 ml of dried tetrahydrofuran and 8 ml of triethylamine were mixed together and stirred under the flow of argon gas. Dropped into the mixture was a solution containing 34.5 g of ethylene glycol bischloroformate and 20 ml of dried tetrahydrofuran, and further 5 ml of dried tetrahydrofuran containing 0.1 g of phenol was added thereto, and then the mixture was stirred for five minutes. Thereafter, the resultant mixture was filtered to remove triethylaminehydrochloride. A filtrate was dropped into methanol to obtain a polymer. The polymer thus obtained was filtered and sufficiently rinsed with ethanol, and then was dried to obtain 9.1 g of electric charge transporting polyester (116). The Mw of this polymer measured by GPC was $1.83\times10^5$ (conversion in styrene, the degree of polymerization p=approximately 260).

An electrophotographic photoreceptor was prepared and a similar test was conducted as in Example 1 except that the electric charge transporting polymer (116) was used for the surface layer. The results are shown in Table 11.

(Example 16)

Figure 6:
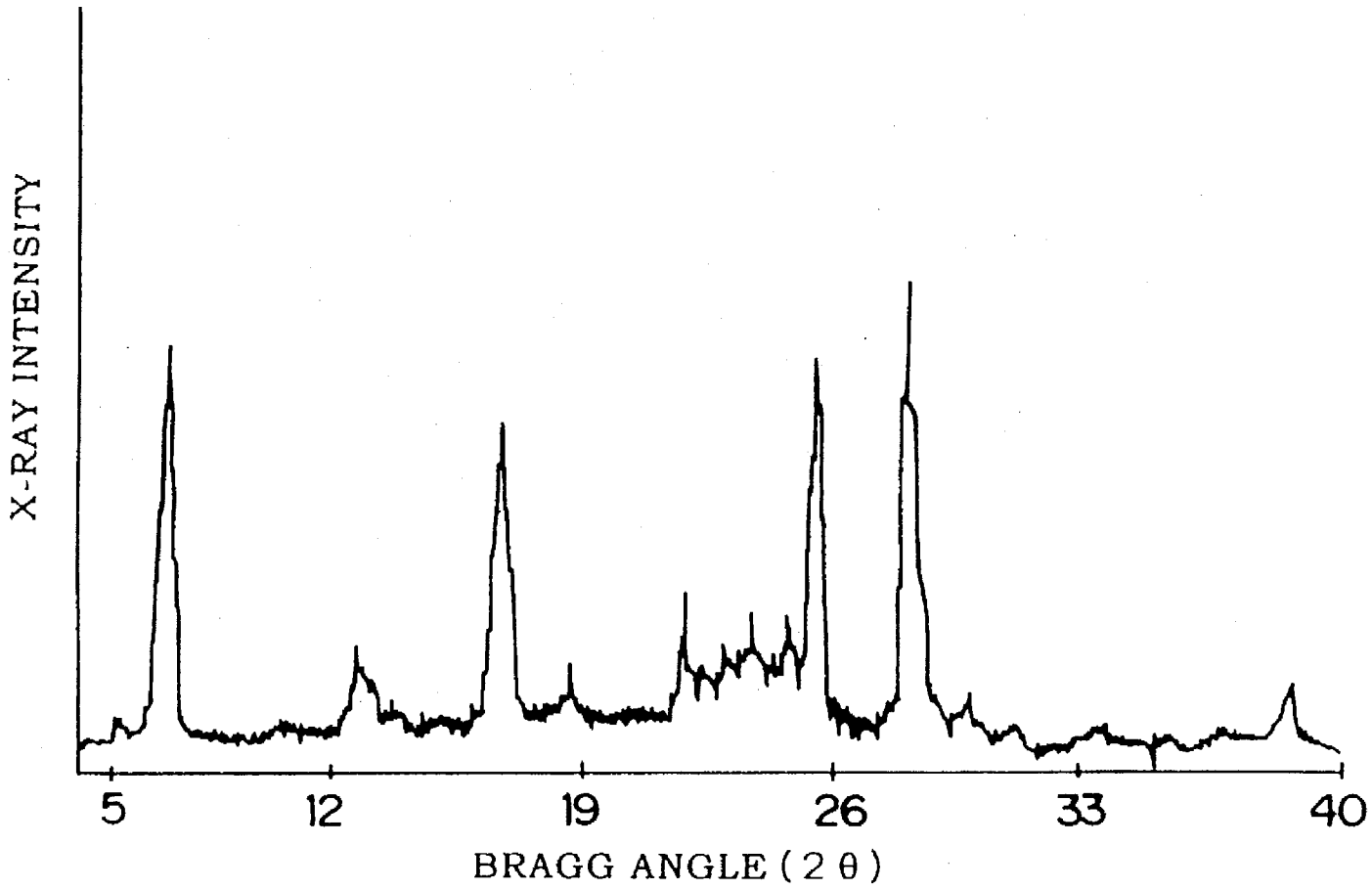
FIG. 6 is a graph illustrating an X-ray diffraction pattern of a powder of chlorogallium phthalocyanine crystals used in Example 15.

An electrophotographic photoreceptor was prepared and a similar test was conducted as in Example 1 except that chlorogallium phthalocyanine crystals showing an X-ray diffraction pattern as shown in FIG. 6 were used for the electric charge generating material. The results are shown in Table 11.

(Example 17)

Figure 7:
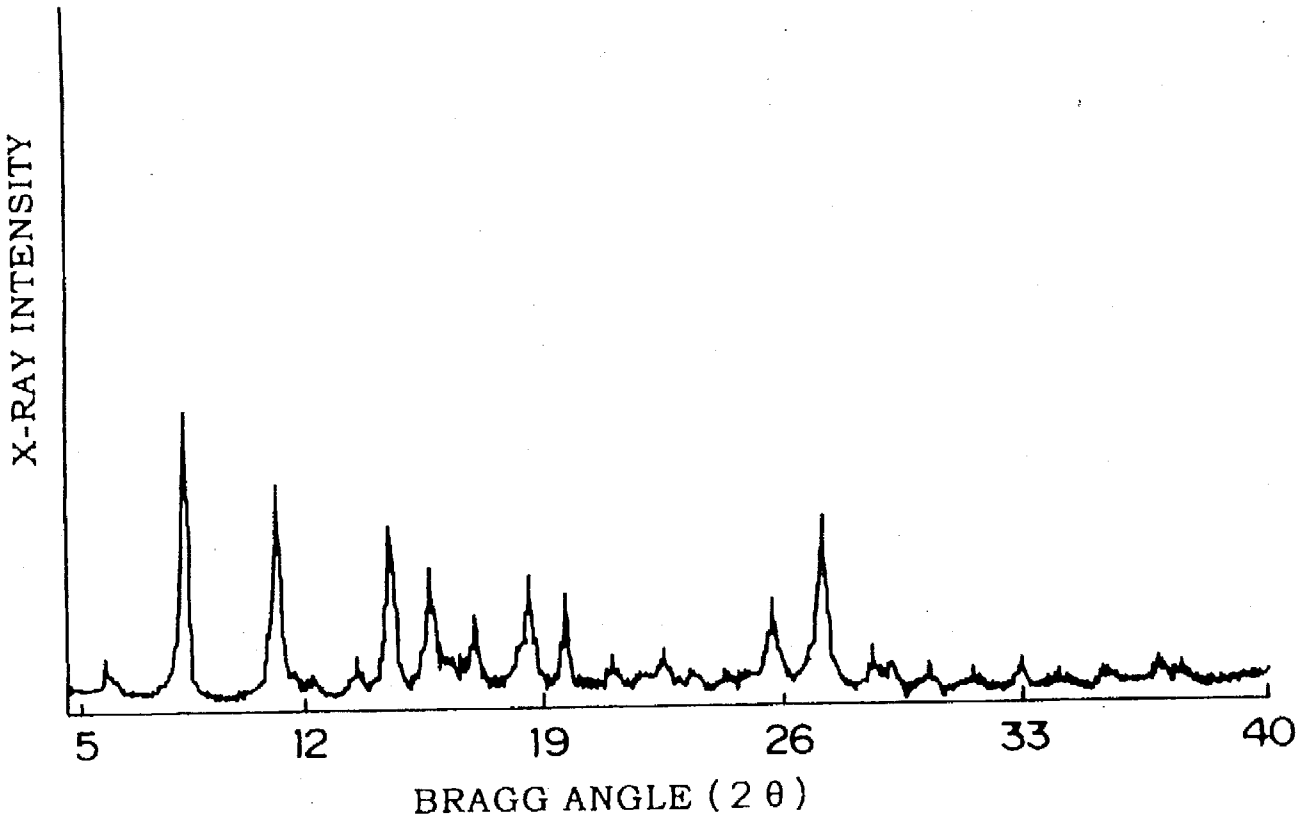
FIG. 7 is a graph illustrating an X-ray diffraction pattern of a powder of dichlorostannic phthalocyanine crystals used in Example 16.

An electrophotographic photoreceptor was prepared and a similar test was conducted as in Example 1 except that dichlorostannic phthalocyanine crystals showing an X-ray diffraction pattern as shown in FIG. 7 were used for the electric charge generating material. The results are shown in Table 11.

(Example 18)

Figure 8:
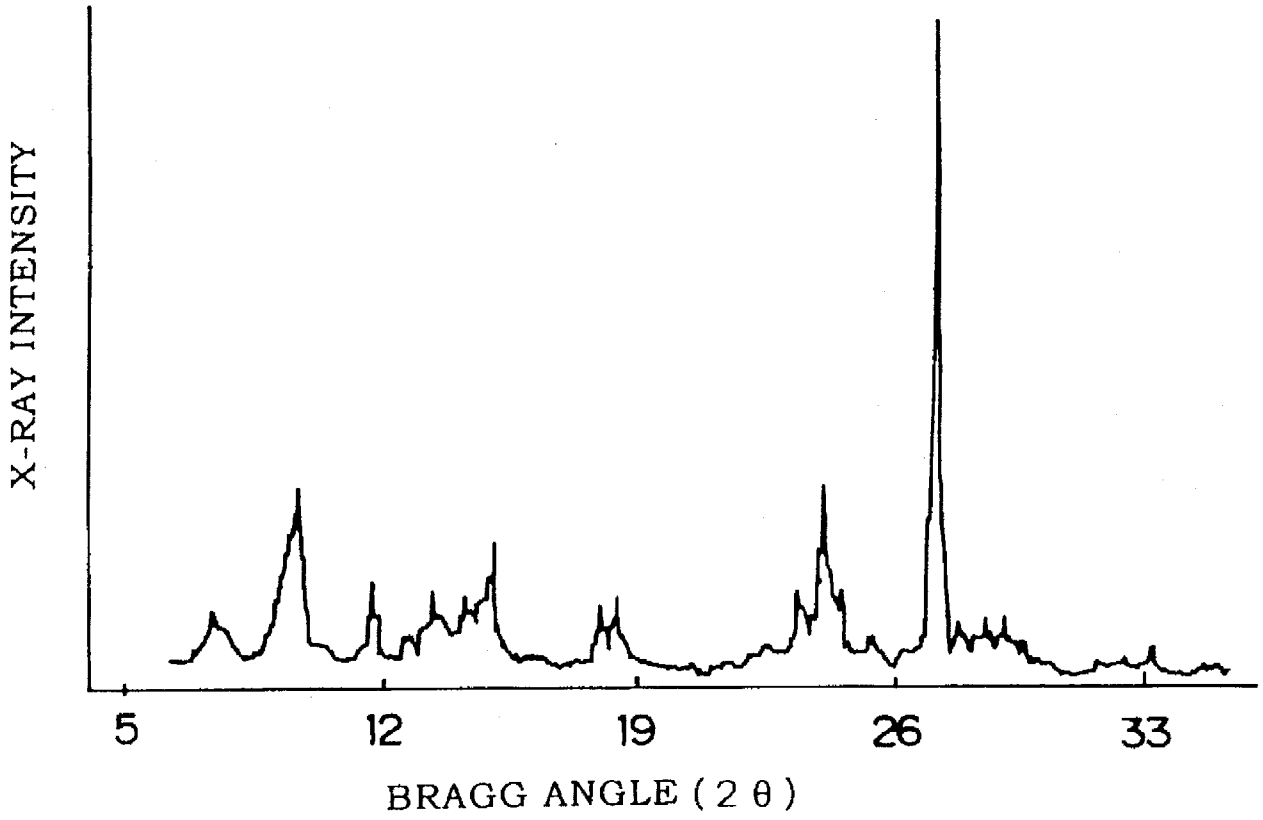
FIG. 8 is a graph illustrating an X-ray diffraction pattern of a powder of oxytitanyl phthalocyanine crystals used in Example 17.

An electrophotographic photoreceptor was prepared and a similar test was conducted as in Example 1 except that oxytitanylphthalocyanine crystals showing an X-ray diffraction pattern as shown in FIG. 8 were used for the electric charge generating material. The results are shown in Table 11.

(Control 1)

An electrophotographic photoreceptor was prepared and a similar test was conducted as in Example 1 except that a methanol/butanol (the ratio by weight is 2:1) solution containing 8-nylon resin (trade name: Luckamid 5003 available from Dainippon Ink and Chemicals, Inc.) was used for the coating liquid of the undercoating layer. The results are shown in Table 11.

(Control 2)

An electrophotographic photoreceptor was prepared and a similar test was conducted as in Example 1 except that a nylon resin polymerized with four types of monomers (trade name:CM8000 available from Toray Industries, Inc.) was used for the coating liquid of the undercoating layer. The results are shown in Table 11.

(Control 3)

An electrophotographic photoreceptor was prepared and a similar test was conducted as in Example 1 except that a mixture with 2 parts of an electric charge transporting material represented by the following constitutional formula (XII) and 3 parts of a polycarbonate resin represented by the following constitutional formula (XIII) being dissolved into 20 parts of monochlorobenzene was used for the coating liquid of the electric charge transporting layer. The results are shown in Table 11.

Formula (XII)

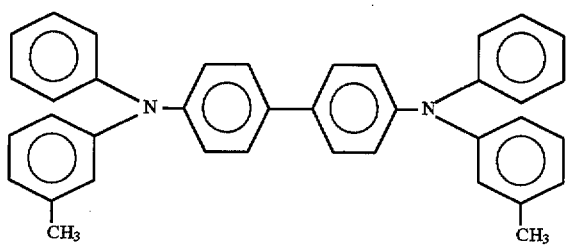

Formula (XIII)

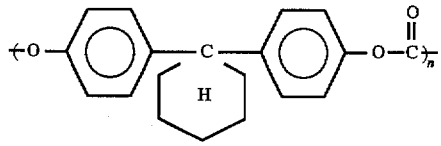

TABLE 10

| Example | Initial potential Pot. A $V_H$ (V) | Initial potential Pot. B $V_L$ (V) | Initial potential Pot. C $V_{RP}$ (V) | Potential after repetition of 10,000 printing Pot. A $V_H$ (V) | Potential after repetition of 10,000 printing Pot. B $V_L$ (V) | Potential after repetition of 10,000 printing Pot. C $V_{RP}$ (V) | Stability with respect to environment Pot. A $\Delta V_H$ (V) | Stability with respect to environment Pot. B $\Delta V_L$ (V) | Stability with respect to environment Pot. C $\Delta V_{RP}$ (V) | Occurrence of streaks after endurance test of 10,000 printing Scorotron charging | Occurrence of streaks after endurance test of 10,000 printing Roll charging |
|---|---|---|---|---|---|---|---|---|---|---|---|
| 1 | −700 | −20 | −5 | −695 | −20 | −5 | 15 | 10 | 5 | No | No |
| 2 | −710 | −15 | −5 | −695 | −15 | −5 | 10 | 10 | 10 | No | No |
| 3 | −695 | −15 | −10 | −680 | −15 | −10 | 10 | 15 | 5 | No | No |
| 4 | −700 | −15 | −5 | −690 | −15 | −10 | 10 | 10 | 10 | No | No |
| 5 | −710 | −20 | −5 | −695 | −25 | −10 | 20 | 10 | 5 | No | No |
| 6 | −690 | −20 | −10 | −680 | −15 | −10 | 15 | 10 | 10 | No | No |
| 7 | −705 | −20 | −15 | −690 | −20 | −10 | 15 | 10 | 10 | No | No |
| 8 | −700 | −25 | −10 | −685 | −20 | −15 | 20 | 10 | 15 | No | No |
| 9 | −700 | −20 | −5 | −695 | −20 | −5 | 15 | 10 | 5 | No | No |
| 10 | −690 | −20 | −15 | −680 | −30 | −20 | 20 | 15 | 10 | No | No |

Notes: Pot. A, Pot. B and Pot. C mean Potential A, Potential B and Potential C, respectively.

TABLE 11

| Example | Initial potential Pot. A $V_H$ (V) | Initial potential Pot. B $V_L$ (V) | Initial potential Pot. C $V_{RP}$ (V) | Potential after repetition of 10,000 printing Pot. A $V_H$ (V) | Potential after repetition of 10,000 printing Pot. B $V_L$ (V) | Potential after repetition of 10,000 printing Pot. C $V_{RP}$ (V) | Stability with respect to environment Pot. A $\Delta V_H$ (V) | Stability with respect to environment Pot. B $\Delta V_L$ (V) | Stability with respect to environment Pot. C $\Delta V_{RP}$ (V) | Occurrence of streaks after endurance test of 10,000 printing Scorotron charging | Occurrence of streaks after endurance test of 10,000 printing Roll charging |
|---|---|---|---|---|---|---|---|---|---|---|---|
| Example 11 | −695 | −15 | −10 | −680 | −20 | −20 | 20 | 10 | 5 | No | No |
| Example 12 | −680 | −15 | −15 | −665 | −15 | −15 | 15 | 15 | 10 | No | No |
| Example 13 | −700 | −20 | −15 | −680 | −20 | −15 | 15 | 10 | 10 | No | No |
| Example 14 | −705 | −20 | −10 | −680 | −25 | −15 | 10 | 15 | 15 | No | No |
| Example 15 | −695 | −15 | −15 | −670 | −15 | −20 | 10 | 15 | 10 | No | No |
| Example 16 | −685 | −40 | −20 | −665 | −50 | −25 | 20 | 30 | 20 | No | No |
| Example 17 | −695 | −60 | −20 | −670 | −60 | −25 | 30 | 30 | 20 | No | No |
| Example 18 | −695 | −30 | −15 | −665 | −40 | −25 | 40 | 60 | 30 | No | No |
| Control 1 | −685 | −150 | −50 | −665 | −170 | −80 | 60 | 100 | 80 | Occurrence | Occurrence |
| Control 2 | −670 | −140 | −55 | −660 | −160 | −70 | 50 | 120 | 70 | Occurrence | Occurrence |
| Control 3 | −710 | −20 | −10 | −700 | −20 | −15 | 30 | 50 | 50 | Occurrence | Occurrence |

It was found that, as clearly seen from Tables 10 and 11, any of the photoreceptors of the present invention comprising the undercoating layer and surface layer had excellent initial potential properties and the stability with respect to environment and had excellent durability with no deterioration in the potential properties even after repetition of 10,000 printing and no occurrence of black streaks. Meanwhile, controls 1 and 2 in which the undercoating layer included no pigment or organometallic compound having electric charge transporting properties, was found to be inferior in the durability and stability with respect to environment. Further, in the case of Control 3 in which the undercoating layer containing the electron transporting pigments was provided and the surface layer containing the electric charge transporting polycarbonate resin or the electric charge transporting polyester resin was not provided, the potential characteristics after repetition of 10,000 printing did not deteriorate very much, but black streaks were caused by the scorotron charging and roll charging. As a result, the structure of control 3 was confirmed to be inferior in the durability from the standpoint of obtained images.

What is claimed is:

1. An electrophotographic photoreceptor in which an undercoating layer and a photosensitive layer are provided on a conductive substrate, wherein the undercoating layer contains an electron transporting pigment and a reactive organometallic compound, and a surface layer of the electrophotographic photoreceptor contains at least one resin selected from electric charge transporting polycarbonate and electric charge transporting polyester.

2. An electrophotographic photoreceptor according to claim 1, wherein an electron transporting polycyclic quinone pigment is used as said electron transporting pigment.

3. An electrophotographic photoreceptor according to claim 2, wherein said electron transporting polycyclic quinone pigment is brominated anthoanthrone.

4. An electrophotographic photoreceptor according to claim 1, wherein an electron transporting perylene pigment is used as said electron transporting pigment.

5. An electrophotographic photoreceptor according to claim 1, wherein an electron transporting phthalocyanine pigment is used as said electron transporting pigment.

6. An electrophotographic photoreceptor according to claim 1, wherein an electron transporting azo pigment is used as said electron transporting pigment.

7. An electrophotographic photoreceptor according to claim 1, wherein the resin selected from the electric charge transporting polycarbonate resin and the electric charge transporting polyester resin has an aryl-amine structure.

8. An electrophotographic photoreceptor according to claim 1, wherein the resin selected from the electric charge transporting polycarbonate resin and the electric charge transporting polyester resin has at least one structure selected from the group consisting of the following general formula (I-1) and (I-2) as a partial structure of a repeating unit:

(I-1)

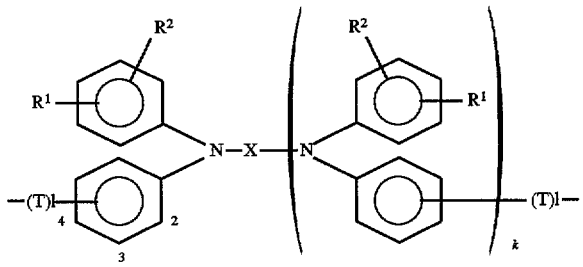

(I-2)

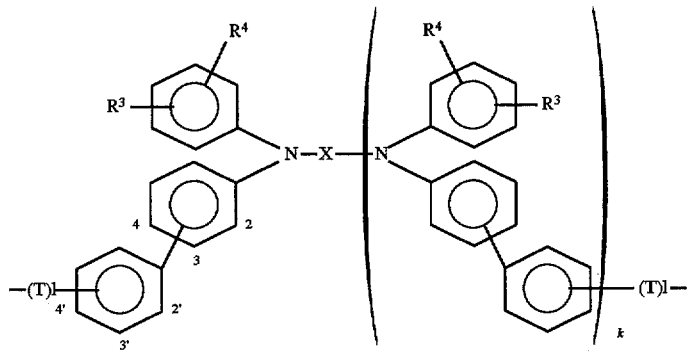

wherein $R^1$ to $R^4$ each independently is a hydrogen atom, an alkyl group, an alkoxy group, a substituted amino group, a halogen atom, or a substituted or an unsubstituted aryl group; X represents a substituted or an unsubstituted arylene group; k and l each independently is an integer selected from 0 and 1; and T represents an optionally branched, divalent hydrocarbon group having 1 to 10 carbon atoms.

9. An electrophotographic photoreceptor according to claim 1, wherein the resin selected from the electric charge transporting polycarbonate resin and the electric charge transporting polyester resin is selected from the group the group consisting of any one of the following general formulae (II), (III) and (IV):

$$+CO-A-CO-O-(Y-O)_{m}\rfloor_{p} \quad \text{(II)}$$

$$+CO-A-CO-O-(Y-O)_{m2}-CO-Z-CO-O-(Y-O)_{m2}\rfloor_{p2} \quad \text{(III)}$$

$$+O-A-O-CO-(B-CO)_{n}\rfloor_{p3} \quad \text{(IV)}$$

wherein A is the structure represented by the general formula (I-1) or (I-2); B represents $-O-(Y^2O)_{m'}$ or $-Z^2-$; Y and $Y^2$ represent divalent hydrocarbon groups; Z and $Z^2$ represent divalent hydrocarbon groups; m, $m^2$ and m' each represents an integer of 1 to 5; n represents an integer selected from 0 and 1; and p, $p^2$ and $p^3$ each represents an integer of 5 to 5000.

10. An electrophotographic photoreceptor according to claim 1, wherein said photosensitive layer contains, as an electric charge generating material, at least one selected from the group consisting of halogenated gallium phthalocyanine crystals, tin-halide phthalocyanine crystals, hydroxygallium phthalocyanine crystals, and oxytitanyl phthalocyanine crystals.

11. An electrophotographic photoreceptor according to claim 1, wherein said reactive organometallic compound is selected from the group consisting of an organic zircon into compounds, organic titanium compounds, and organic aluminum compounds.

12. An electrophotographic photoreceptor according to claim 1, wherein a ratio by weight of the electron transporting pigment to the reactive organometallic compound is set in the range of 100:1 to 1:1.

13. An electrophotographic photoreceptor according to claim 1, wherein said photosensitive layer comprises an electric charge generating/electric charge transporting layer, or comprises an electric charge generating layer and an electric charge transporting layer.

14. An electrophotographic photoreceptor according to claim 13, wherein the surface layer is an electric charge generating/electric charge transporting layer, or an electric charge transporting layer.

15. An electrophotographic photoreceptor in which an undercoating layer and a photosensitive layer are provided on a conductive substrate, wherein the undercoating layer contains an electron transporting pigment and a reactive organometallic compound, the electron transporting pigment being selected from the group consisting of an electron transporting polycyclic quinone pigment, an electron transporting perylene pigment, an electron transporting phthalocyanine pigment, and an electron transporting azo pigment, and wherein a surface layer of the electrophotographic photoreceptor contains at least one resin selected from the group consisting of electric charge transporting polycarbonate and electric charge transporting polyester, the electrical charge transporting polycarbonate and electrical charge transporting polyester being represented by any of the following general formulae (II), (III) and (IV):

$$\left[CO-A-CO-O-\left(Y-O\right)_{m}\right]_{p} \quad \text{(II)}$$

$$\left[CO-A-CO-O-\left(Y-O\right)_{m_2}-CO-Z-CO-O-\left(Y-O\right)_{m_2}\right]_{p_2} \quad \text{(III)}$$

$$\left[O-A-O-CO-\left(B-CO\right)_{n}\right]_{p3} \quad \text{(IV)}$$

wherein A is the structure represented by the following general formula (I-1) or (I-2); B represents —O—$(Y^2O)_{m'}$ or —$Z^2$—; Y and $Y^2$ represent divalent hydrocarbon groups; Z and $Z^2$ represent divalent hydrocarbon groups; m, $m^2$ and m' each represents an integer of 1 to 5; n represents an integer selected from 0 and 1; and p, $p^2$, $p^3$ each represents an integer of 5 to 5000:

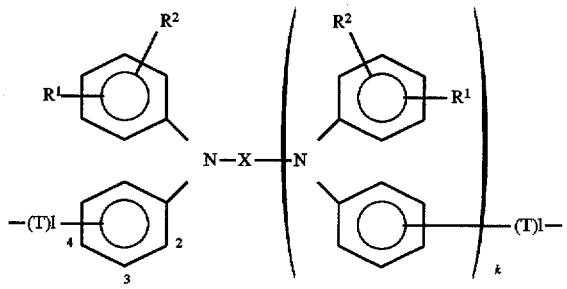

(I-1)

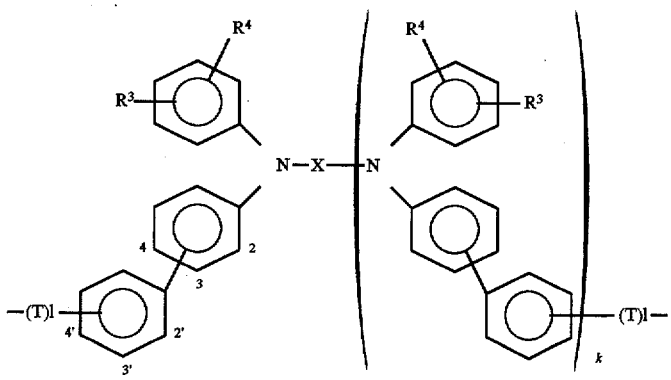

(I-2)

wherein $R^1$ to $R^4$ each independently is a hydrogen atom, an alkyl group, an alkoxy group, a substituted amino group, a halogen atom, or a substituted or an unsubstituted aryl group; X is a substituted or an unsubstituted arylene group; k and l each independently represents an integer selected from 0 and 1; and T is an optionally branched, divalent hydrocarbon group having 1 to 10 carbon atoms.

16. An electrophotographic photoreceptor according to claim 15, wherein said reactive organometallic compound is selected from group consisting of an organic zirconium compounds, organic titanium compounds, and organic aluminum compounds.

17. An electrophotographic photoreceptor according to claim 15, wherein said photosensitive layer comprises an electric charge generating/electric charge transporting layer, or comprises an electric charge generating layer and an electric charge transporting layer.

18. An electrophotographic photoreceptor according to claim 17, wherein the surface layer is an electric charge generating/electric charge transporting layer, or an electric charge transporting layer.

19. An electrophotographic photoreceptor according to claim 17, wherein said electric charge generating/electric charge transporting layer, or said electric charge generating layer contains, as an electric charge generating material, at least one selected from the group consisting of halogenated gallium phthalocyanine crystals, tin-halide phthalocyanine crystals, hydroxygallium phthalocyanine crystals, and oxytitanyl phthalocyanine crystals.

20. An electrophotographic photoreceptor according to claim 15, wherein a ratio by weight of the electron transporting pigment to the reactive organometallic compound is set in the range of 100:1 to 1:1.

* * * * *